US010648441B2

(12) United States Patent
Tamane et al.

(10) Patent No.: US 10,648,441 B2
(45) Date of Patent: May 12, 2020

(54) REMOTE STARTUP SYSTEM AND CENTER SERVER

(71) Applicant: TOYOTA JIDOSHA KABUSHIKI KAISHA, Toyota-shi, Aichi-ken (JP)

(72) Inventors: Yasuyuki Tamane, Miyoshi (JP); Masato Endo, Nagakute (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 95 days.

(21) Appl. No.: 15/949,764

(22) Filed: Apr. 10, 2018

(65) Prior Publication Data

US 2018/0298865 A1 Oct. 18, 2018

(30) Foreign Application Priority Data

Apr. 12, 2017 (JP) ..... 2017-079287

(51) Int. Cl.
*F02N 11/08* (2006.01)
*F02N 11/10* (2006.01)

(52) U.S. Cl.
CPC ..... *F02N 11/0807* (2013.01); *F02N 11/101* (2013.01); *F02N 2200/0806* (2013.01); *F02N 2200/123* (2013.01); *F02N 2200/125* (2013.01); *F02N 2300/2002* (2013.01); *F02N 2300/306* (2013.01)

(58) Field of Classification Search
USPC ..... 701/2
See application file for complete search history.

(56) References Cited

U.S. PATENT DOCUMENTS 9,062,617 B2 * 6/2015 Mauti, Jr. ..... F02D 29/02
9,288,270 B1 * 3/2016 Penilla ..... H04L 67/306
2013/0268139 A1 10/2013 Endo
2014/0200742 A1 * 7/2014 Mauti, Jr. ..... F02D 29/02 701/2
2014/0371951 A1 * 12/2014 Michael ..... F02N 11/0807 701/2
2015/0258961 A1 * 9/2015 Doherty ..... B60R 25/042 701/2
2015/0330318 A1 * 11/2015 Petersen ..... G06Q 10/00 701/113
2019/0176752 A1 * 6/2019 Cermak ..... B60R 25/01

FOREIGN PATENT DOCUMENTS

JP 2013-217278 A 10/2013
JP 2013-238184 A 11/2013

* cited by examiner

*Primary Examiner* — Tyler D Paige
(74) *Attorney, Agent, or Firm* — Hunton Andrews Kurth LLP

(57) ABSTRACT

A remote startup system includes a terminal of a user, a center server that is configured to communicate with the terminal, and a vehicle that is configured to communicate with the center server, and starts up an engine of the vehicle according to a startup request transmitted from the terminal to the center server. The remote startup system includes a position information acquisition unit that acquires position information of the vehicle, a time information acquisition unit that acquires time information, and a controller that changes a performance manner of the startup of the engine based on the startup request including whether the startup of the engine is permitted according to the position information of the vehicle and the time information when the startup request is transmitted from the terminal to the center server.

10 Claims, 12 Drawing Sheets

REMOTE STARTUP SYSTEM AND CENTER SERVER

INCORPORATION BY REFERENCE

The disclosure of Japanese Patent Application No. 2017-079287 filed on Apr. 12, 2017 including the specification, drawings and abstract is incorporated herein by reference in its entirety.

BACKGROUND

1. Technical Field

The present disclosure relates to a remote startup system for a vehicle engine, and a center server.

2. Description of Related Art

A center type remote startup system that starts up an engine of a vehicle according to a startup request transmitted from a terminal carried by a user to a vehicle remotely located via a center server has been known (see, for example, Japanese Unexamined Patent Application Publication No. 2013-238184 (JP 2013-238184 A), or the like).

JP 2013-238184 A discloses a technology for prohibiting startup of an engine of a vehicle based on a startup request from a terminal in a region in which idling of the engine of the vehicle is restricted by laws and regulations or the like.

SUMMARY

However, even in a region in which there is no problem with idling of an engine of a vehicle by laws and regulations, or the like, a situation that causes inconvenience to neighboring residents may occur according to environmental conditions of a parked vehicle, for example, conditions such as regional characteristics such as whether or not a vehicle is in a residential area or characteristics of a time period such as whether or not it is nighttime. In particular, when the engine of the vehicle is started up via a center server, the engine of the vehicle can be started up even from a relatively separated place at which a user cannot visually recognize the vehicle, and therefore, the user may be unable to appropriately decide an influence of, for example, regional characteristics or characteristics of a time period at a place at which the vehicle is parked.

Therefore, the present disclosure provides a center type remote startup system and a center server capable of starting up an engine of a vehicle in consideration of environmental conditions of a parked vehicle even when a user is at a position relatively separated from the vehicle.

A first aspect of the present disclosure relates to a remote startup system. The remote startup system includes a terminal of a user, a center server that is configured to communicate with the terminal, and a vehicle that is configured to communicate with the center server. The remote startup system is configured to start up an engine of the vehicle according to a startup request transmitted from the terminal to the center server. The remote startup system includes a position information acquisition unit configured to acquire position information of the vehicle; a time information acquisition unit configured to acquire time information; and a controller configured to change a performance manner of the startup of the engine based on the startup request including whether or not the startup of the engine is permitted according to the position information of the vehicle and the time information when the startup request is transmitted from the terminal to the center server.

According to the first aspect of the present disclosure, the controller, for example, can prohibit the startup of the engine of the vehicle in a region in which idling is prohibited in a time period to which a time determined by laws and regulations belongs or start up the engine of the vehicle on condition that a procedure for confirmation as to whether the startup of the engine is desired to be really performed is made after the startup request is transmitted in a residential area at nighttime even in a region that is not a target of the laws and regulations. Therefore, even when the user is at a position relatively separated from the vehicle, the engine of the vehicle can be started up in consideration of environmental conditions of the parked vehicle.

The remote startup system according to the first aspect of the present disclosure may further include a degree-of-permission determination unit configured to determine a degree of permission of idling of the engine at a time when a position of the vehicle and the startup request are transmitted, according to the position information and the time information. The controller may be configured to change the performance manner such that the startup of the engine based on the startup request is less likely to be performed as the degree of permission is lower.

According to the first aspect of the present disclosure, the degree-of-permission determination unit can determine the degree of permission to be low in a situation in which the idling is less likely to be permitted, such as a case in which the vehicle is parked in a quiet residential area or a case in which a current time is nighttime. Therefore, it is possible to make it less likely to perform remote startup of the engine of the vehicle in a situation in which idling is less likely to be permitted.

In the remote startup system according to the first aspect of the present disclosure, the controller may be configured to change the performance manner such that the startup of the engine based on the startup request is less likely to be performed in a case in which the time information indicates nighttime, as compared with a case in which the time information indicates daytime.

According to the first aspect of the present disclosure, it is possible to make it less likely to perform idling at nighttime when an influence on the neighboring residents is large.

In the remote startup system according to the first aspect of the present disclosure, the controller may be configured to change the performance manner such that the startup of the engine based on the startup request is less likely to be performed in a case in which the position information indicates a residential area or an indoor area, as compared with a case in which the position information indicates neither the residential area nor the indoor area.

According to the first aspect of the present disclosure, it is possible to make it less likely to perform idling in the indoor area that is not desirable from the viewpoint of residential areas having a large influence on neighboring residents, fullness of exhaust gas, or echoes of noise.

In the remote startup system according to the first aspect of the present disclosure, a plurality of vehicles may be provided, and the controller may be configured to change the performance manner such that the startup of the engine based on the startup request of one of the vehicles is easily performed as achievement of the startup of the engine based on a startup request of the vehicles in a region corresponding to the position information is higher.

According to the first aspect of the present disclosure, since it is considered that there is no problem even when idling is performed in the region in which the vehicle is parked as startup achievement (idling achievement) of the engine of the vehicle based on the startup request in the region in which the vehicle is parked is higher, the remote startup of the engine of the vehicle is easily performed. Therefore, it is possible to start up the engine of the vehicle in consideration of the environmental conditions of the parked vehicle in a more practical manner based on the idling achievement.

A second aspect of the present disclosure relates to a remote startup system. The remote startup system includes a terminal of a user, a center server that is configured to communicate with the terminal, and a vehicle that is configured to communicate with the center server. The remote startup system is configured to start up an engine of the vehicle according to a startup request transmitted from the terminal to the center server. The remote startup system includes a position information acquisition unit configured to acquire position information of the vehicle; a time information acquisition unit configured to acquire time information; and a notification unit provided in the terminal, the notification unit being configured to perform notification regarding performance of startup of the engine based on the startup request when the startup request is transmitted from the terminal to the center server. The notification unit is configured to change content of the notification according to the position information of the vehicle and the time information.

According to the second aspect of the present disclosure, the notification unit, for example, can perform a notification indicating that the startup of the engine of the vehicle cannot be performed when the vehicle is parked in a region in which idling is prohibited in a time period to which the time determined by laws and regulations belongs, and can perform a notification such as confirmation as to whether the startup of the engine is desired to be really performed after the startup request has been transmitted when the vehicle is parked in a residential area at nighttime even in a region that is not a target of the laws and regulations. Therefore, even when the user is at a position relatively separated from the vehicle, the user can appropriately decide environmental conditions of the parked vehicle, and therefore, can start up the engine of the vehicle in consideration of the environmental conditions.

The remote startup system according to a second aspect of the present disclosure may further include a degree-of-permission determination unit configured to determine a degree of permission of idling of the engine at a time when a position of the vehicle and the startup request are transmitted, according to the position information and the time information. The notification unit may be configured to change content of the notification such that the user is less likely to decide to perform the startup of the engine based on the startup request or decide to continue an idling state after the startup as the degree of permission is lower.

According to the second aspect of the present disclosure, the degree-of-permission determination unit can determine the degree of permission to be low in a situation in which the idling is less likely to be permitted, such as a case in which the vehicle is parked in a quiet residential area or a case in which a current time is nighttime. Therefore, for example, in a situation in which the idling is less likely to be permitted, the notification unit can perform a notification to re-confirm whether the startup of the engine of the vehicle is desired to be really performed after transmission of the startup request or can perform a notification indicating that the startup of the engine of the vehicle can be canceled after the startup of the engine of the vehicle such that the user is less likely to decide to perform the startup of the engine of the vehicle or decide to continue an idling state of the engine of the vehicle. Therefore, it is possible to suppress remote startup of the engine of the vehicle in a situation in which idling is less likely to be permitted, or suppress the continuation of the idling state of the engine of the vehicle.

In the remote startup system according to the second aspect of the present disclosure, the notification unit may be configured to change content of the notification such that the user is less likely to decide to perform the startup of the engine based on the startup request or decide to continue an idling state after the startup in a case in which the time information indicates nighttime, as compared with a case in which the time information indicates daytime.

According to the second aspect of the present disclosure, it is possible to suppress the remote startup of the engine of the vehicle, continuation of the idling state, and the like at nighttime when the influence on the neighboring residents is large.

In the remote startup system according to the second aspect of the present disclosure, the notification unit may be configured to change content of the notification such that the user is less likely to decide to perform the startup of the engine based on the startup request or decide to continue an idling state after the startup in a case in which the position information indicates a residential area or an indoor area, as compared with a case in which the position information indicates neither the residential area nor the indoor area.

According to the second aspect of the present disclosure, it is possible to suppress, for example, the remote startup of the engine of the vehicle or continuation of the idling state in an indoor area that is not desirable from the viewpoint of residential areas having a large influence on neighboring residents, fullness of exhaust gas, or echoes of noise.

In the remote startup system according to the second aspect of the present disclosure, a plurality of vehicles may be provided, and the notification unit may be configured to change content of the notification such that the user easily decides to perform the startup of the engine based on the startup request of one of the vehicles or decide to continue an idling state after the startup as achievement of the startup of the engine based on a startup request of the vehicles in a region corresponding to the position information is higher.

According to the second aspect of the present disclosure, since it is considered that there is no problem even when idling is performed in the region in which the vehicle is parked as startup achievement (idling achievement) of the engine of the vehicle based on the startup request in the region in which the vehicle is parked is higher, the user easily decides to remotely start up the engine of the vehicle or decide to continue an idling state after the start. Therefore, it is possible to start up the engine of the vehicle in consideration of the environmental conditions of the parked vehicle in a more practical manner based on the idling achievement.

A third aspect of the present disclosure relates to a center server connected to a terminal of a user and a vehicle and configured to communicate with the terminal and the vehicle. The center server is configured to receive a startup request of an engine of the vehicle that is transmitted from the terminal, and transmit the startup request to the vehicle to start up the engine. The center server includes a position information acquisition unit configured to acquire position information of the vehicle, a time information acquisition unit configured to acquire time information, and a controller configured to change a performance manner of the startup of the engine based on the startup request including whether or not the startup of the engine is permitted according to the position information of the vehicle and the time information when the startup request is received from the terminal.

A fourth aspect of the present disclosure relates to a center server connected to a terminal of a user and a vehicle and configured to communicate with the terminal and the vehicle. The center server is configured to receive a startup request of an engine of the vehicle that is transmitted from the terminal, and transmit the startup request to the vehicle to start up the engine. The center server includes a position information acquisition unit configured to acquire position information of the vehicle, a time information acquisition unit configured to acquire time information, and an information generation unit configured to generate information for determining content of a notification regarding performance of the startup of the engine based on the startup request performed by the terminal when the startup request is received from the terminal. The information generation unit is configured to generate the information such that the content of the notification is changed according to the position information of the vehicle and the time information.

According to the aspects of the present disclosure described above, it is possible to provide a center type remote startup system and a center server capable of starting up an engine of a vehicle in consideration of environmental conditions of the parked vehicle even when a user is at a position relatively separated from the vehicle.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, modes for carrying out the disclosure will be described with reference to the drawings.

Configuration of Remote Startup System

A configuration of the remote startup system 1 according to an embodiment will be described with reference to FIGS. 1 to 4.

Figure 1:
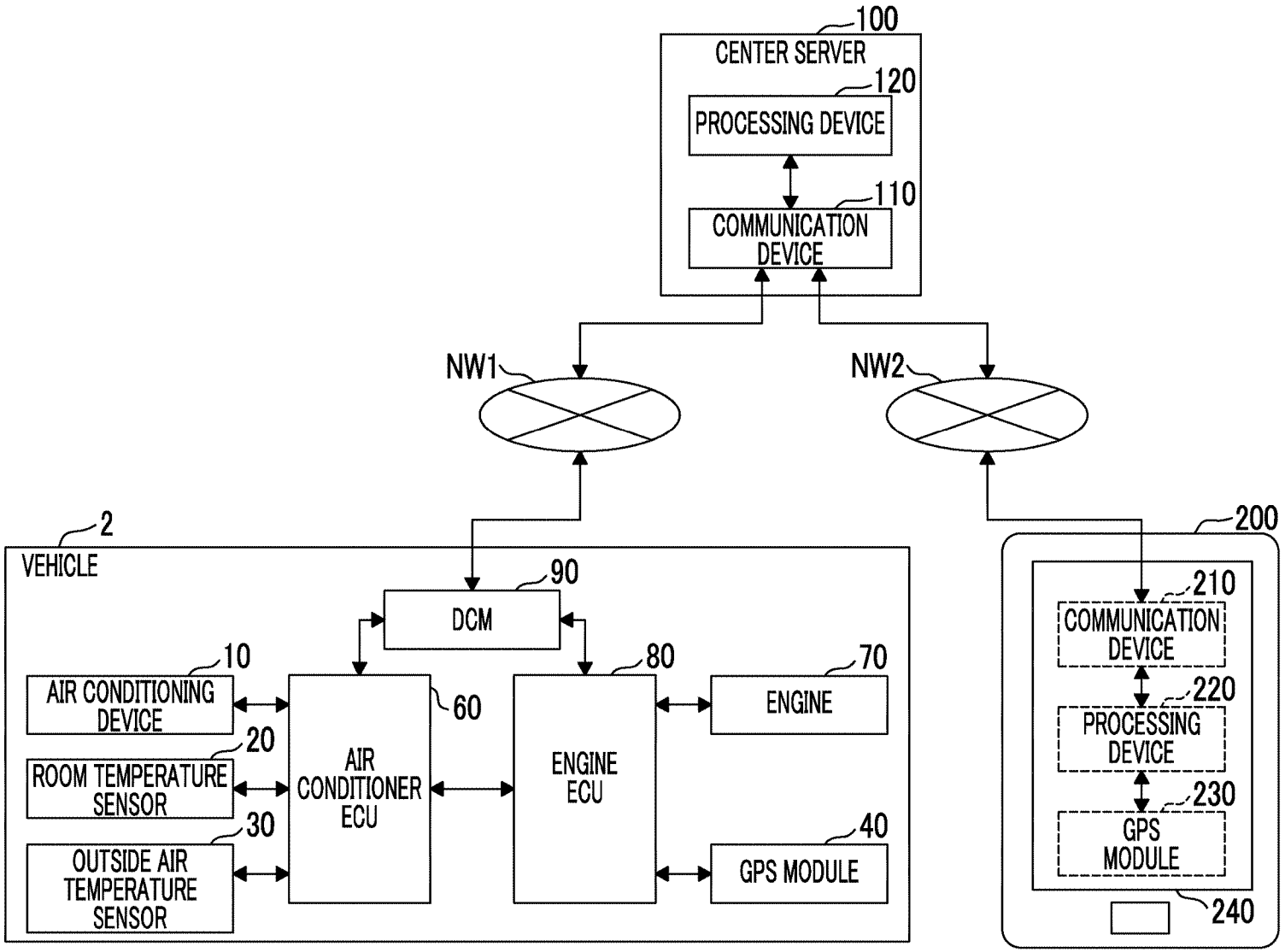
FIG. 1 is a configuration diagram illustrating an example of a configuration of a remote startup system.
Figure 2:
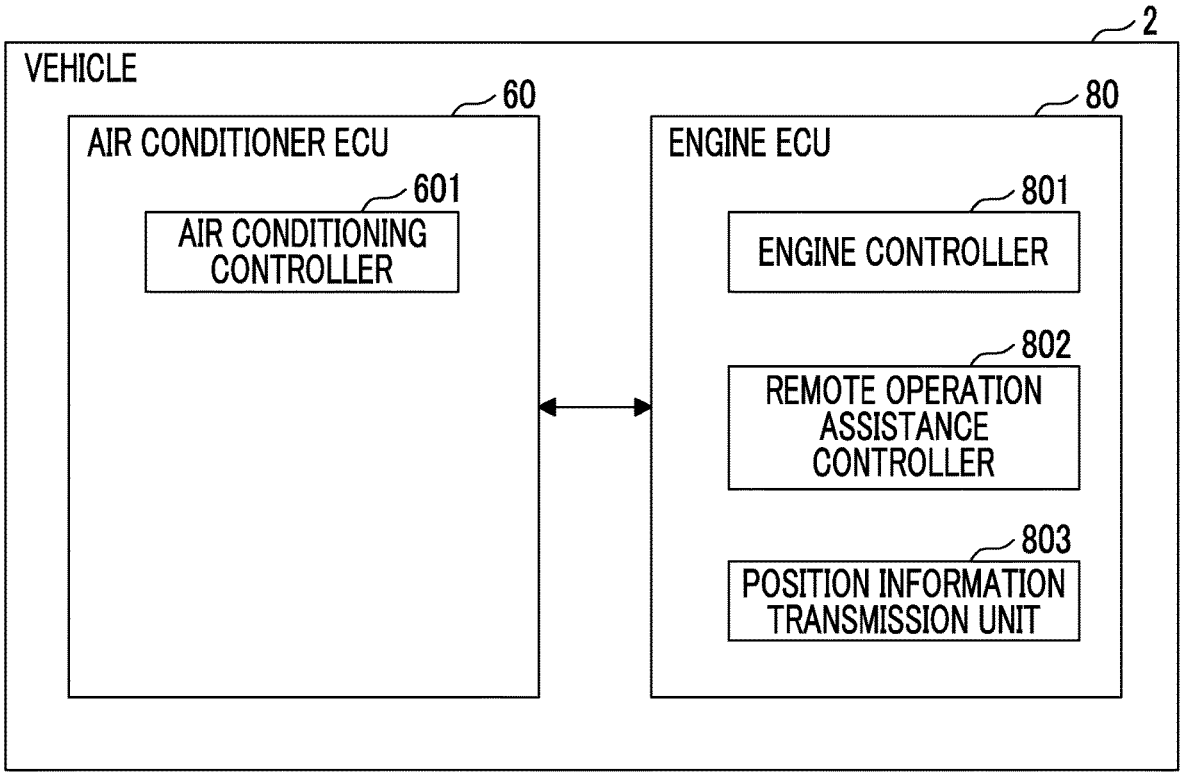
FIG. 2 is a functional block diagram illustrating an example of a functional configuration of a vehicle (an air conditioner ECU or an engine ECU)
Figure 3:
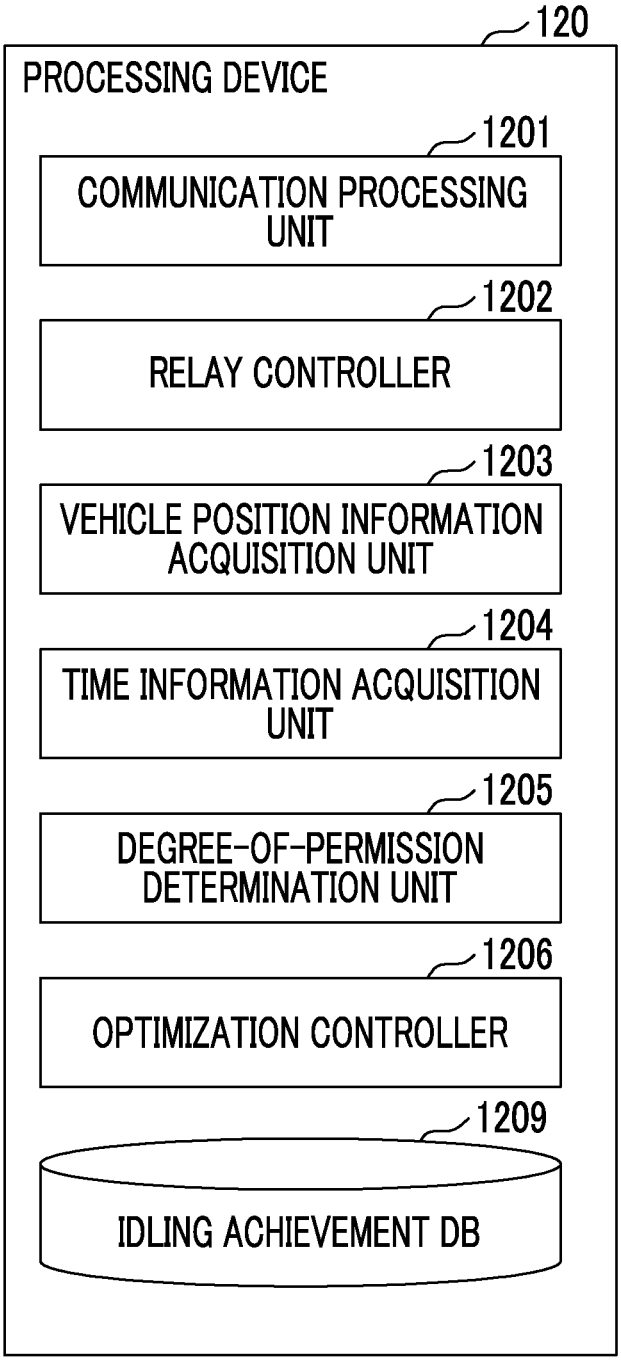
FIG. 3 is a functional block diagram illustrating an example of a functional configuration of a center server (a processing device)
Figure 4:
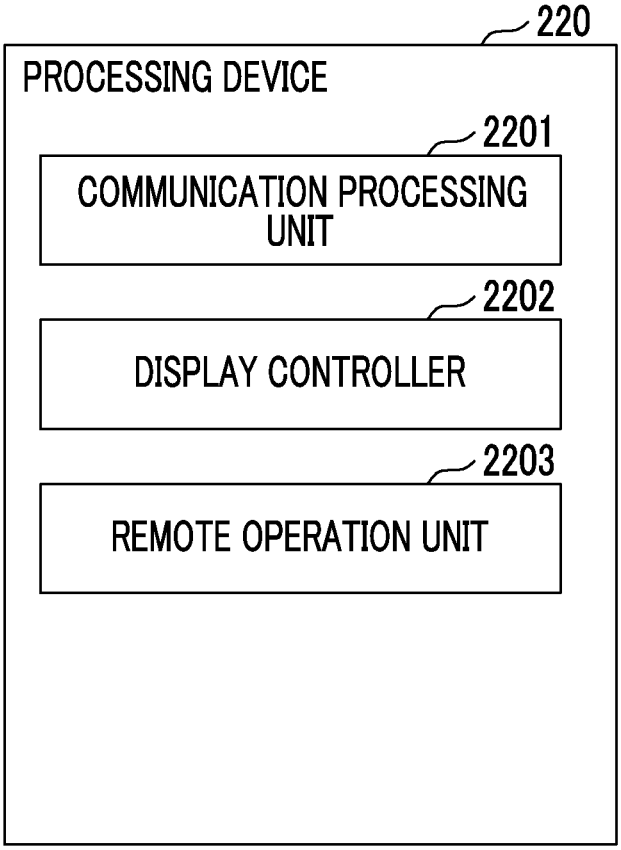
FIG. 4 is a functional block diagram illustrating an example of a functional configuration of a terminal (a processing device)

FIG. 1 is a configuration diagram illustrating an example of a configuration of a remote startup system 1 according to the embodiment. FIG. 2 is a functional block diagram illustrating an example of a functional configuration of a vehicle 2 (an air conditioner ECU 60 or an engine ECU 80) according to the embodiment. FIG. 3 is a functional block diagram illustrating an example of a functional configuration of a center server 100 (a processing device 120) according to the embodiment. FIG. 4 is a functional block diagram illustrating an example of a functional configuration of a terminal 200 (a processing device 220) according to the embodiment.

The remote startup system 1 includes a vehicle 2, a center server 100, and a terminal 200 carried by a user, and starts up an engine 70 and an air conditioning device 10 of the vehicle 2 to be described below according to a startup request that is transmitted from the terminal 200 to the vehicle 2 via the center server 100.

The center server 100 provides a service for starting up the engine of the vehicle (hereinafter referred to as a "remote startup service") according to a startup request that is transmitted from a user terminal, for a plurality of vehicles, and the vehicle 2 representatively indicates one of the vehicles that are targets of the center server 100.

The vehicle 2 includes an air conditioning device 10, a room temperature sensor 20, an outside air temperature sensor 30, a global positioning system (GPS) module 40, the air conditioner electronic control unit (ECU) 60, the engine 70, the engine ECU 80, and a data communication module (DCM) 90.

The air conditioning device 10 adjusts, for example, a temperature in the cabin of the vehicle 2. The air conditioning device 10 includes, for example, a refrigeration cycle including an evaporator (not illustrated) and a compressor (not illustrated) that is driven by the engine 70 of the vehicle, and a heater (not illustrated) using coolant of the engine 70 of the vehicle as a heat source. Under the control of the air conditioner ECU 60 (the air conditioning controller 601 to be described below), the air conditioning device 10 adjusts a temperature of air sent out from an air outlet by appropriately setting a ratio of air cooled by passing through the evaporator (cold air) to air warmed using the coolant of the engine 70 of the vehicle as a heat source (hot air) in a changeable manner. The air conditioning device 10 has a defroster mode, and removes frost that is generated on the outside of a windshield of the vehicle 2 or fog generated on the inside of the windshield of the vehicle 2 by sending air having a relatively low humidity and a relatively high temperature along the windshield of the vehicle 2 from the air outlet corresponding to the defroster mode.

The room temperature sensor 20 is provided on the cabin of the vehicle 2, such as the inside of an instrument panel (not illustrated), and detects a temperature in the cabin (room temperature). The room temperature sensor 20 is communicatably connected to the air conditioner ECU 60 via a one-to-one communication line or the like, and a detection signal corresponding to the detected room temperature is input to the air conditioner ECU 60.

The outside air temperature sensor 30 is provided on the outdoor of the vehicle 2 such as a front end portion of an engine compartment provided in a front portion of the vehicle 2 (a portion into which outside air is introduced), that is, on the back side of a front grille of the vehicle 2, and detects a temperature of the outdoor (outside air temperature) of the vehicle 2. The outside air temperature sensor 30 is communicatably connected to the air conditioner ECU 60 via a one-to-one communication line or the like, and a detection signal corresponding to the detected outdoor air temperature is input to the air conditioner ECU 60.

The GPS module 40 receives GPS signals that are transmitted from three or more satellites, preferably, four or more satellites above the vehicle 2, and measures a position of the vehicle 2 on which the GPS module 40 is mounted. The GPS module 40 is communicatably connected to the engine ECU 80 or the like via a one-to-one communication line or an in-vehicle network such as a controller area network (CAN), and position information of the vehicle 2 of which the position has been measured is transmitted to the engine ECU 80 or the like.

The air conditioner ECU 60 is an electronic control unit that performs various controls regarding the air conditioning device 10. The function of the air conditioner ECU 60 may be realized by any hardware, any software, or a combination thereof, and may be mainly configured of a microcomputer including a CPU, a RAM, a ROM, an I/O, and the like. The air conditioner ECU 60 includes, for example, an air conditioning controller 601 as a functional unit that is realized by executing one or more programs stored in the ROM on the CPU.

The air conditioning controller 601 controls an operation of the air conditioning device 10 according to a set state of a set temperature, a mode (a plurality of air outlet modes according to a combination of the air outlets or defroster mode), and the like. Specifically, the air conditioning controller 601 controls the operation of the air conditioning device 10, for example, so that the room temperature becomes the set temperature, based on a detected value of the room temperature sensor 20, the outside air temperature sensor 30, and the like. The air conditioning controller 601 starts up the air conditioning device 10 according to an air conditioning startup request from a remote operation assistance controller 802 to be described below and controls the operation of the air conditioning device 10 according to setting content included in the air conditioning startup request.

The air conditioner ECU 60, the engine ECU 80, and the DCM 90 are communicatably connected to each other over an in-vehicle network based on a communication protocol of a CAN or the like.

The engine 70 of the vehicle is a source of driving force of the vehicle 2. The engine 70 of the vehicle is operated by burning gasoline, light oil, or the like supplied from a fuel tank (not illustrated) via a fuel pump (not illustrated) in a cylinder under the control of the engine ECU 80. The engine 70 of the vehicle, specifically, various actuators (a fuel injection device that injects fuel, an ignition device that ignites gasoline injected into the cylinder, an electric motor for changing an opening and closing timing of an intake or exhaust valve, or the like) assembled in the engine 70 of the vehicle are communicatably connected to the engine ECU 80 via a one-to-one communication line or the like, and are operated according to a control command transmitted from the engine ECU 80.

The engine ECU 80 is an electronic control unit that performs various control processes of the engine 70 of the vehicle including a starter (not illustrated). A function of the engine ECU 80 may be realized by any hardware, any software, or a combination thereof. For example, the engine ECU 80 may be mainly configured of a microcomputer including a CPU, a RAM, a ROM, an I/O, and the like. The engine ECU 80 includes, for example, an engine controller 801, a remote operation assistance controller 802, and a position information transmission unit 803 as functional units that are realized by executing one or more programs stored in the ROM.

The engine controller 801 performs operation control of the engine 70 of the vehicle according to an operation state by a driver of the vehicle 2 (for example, an accelerator operation amount or a selected gear shift stage of a transmission (not illustrated)), an environmental state of the vicinity of the vehicle 2 (for example, an outside air temperature), or the like. For example, when an ignition switch (IG switch) is turned ON (IG-ON) or when an engine startup request is input from the outside, the engine controller 801 starts up the engine 70 of the vehicle. Specifically, the engine controller 801 switches a relay (not illustrated) for energizing a starter to a connected state to drive the starter, and appropriately controls a fuel injection device and an ignition device according to cranking by the starter to start up the engine 70 of the vehicle.

According to a startup request that is received from the terminal 200 via the center server 100, the remote operation assistance controller 802 transmits an engine startup request and an air conditioning startup request to the engine controller 801 and the air conditioning controller 601, respectively, to start up the engine 70 and the air conditioning device 10 of the vehicle. When a predetermined end condition is satisfied after the engine 70 and the air conditioning device 10 of the vehicle are started up, the remote operation assistance controller 802 transmits an engine stop request and an air conditioning stop request to the engine controller 801 and the air conditioning controller 601, respectively, to stop the engine 70 and the air conditioning device 10 of the vehicle. For example, when a set operation time included in the startup request or defined in advance has elapsed from the startup of the engine 70 and the air conditioning device 10 of the vehicle as an end condition, the remote operation assistance controller 802 may stop the engine 70 and the air conditioning device 10 of the vehicle. Further, for example, when the room temperature has been determined to have increased to a set temperature included in the startup request or defined in advance after the startup of the engine 70 and the air conditioning device 10 of the vehicle as an end condition, the remote operation assistance controller 802 may stop the engine 70 and the air conditioning device 10 of the vehicle. Further, for example, when a signal indicating that an operation for stopping the engine 70 and the air conditioning device 10 of the vehicle has been executed has been received from the terminal 200 via the center server 100 by the DCM 90 as an end condition, the remote operation assistance controller 802 may stop the engine 70 and the air conditioning device 10 of the vehicle.

The function of the remote operation assistance controller 802 may be provided in the air conditioner ECU 60 or may be provided in another ECU that is configured to communicate with the air conditioner ECU 60 and the engine ECU 80 over an in-vehicle network such as a CAN.

The position information transmission unit 803 transmits the position information of the vehicle 2 that is input from the GPS module 40, to the center server 100 via the DCM 90 according to a position information acquisition request that is received from the center server 100 via the DCM 90.

When the GPS module 40 is stopped during the ignition OFF (IG-OFF) of the vehicle 2, the position information transmission unit 803 may acquire, from the internal memory, the position information of the vehicle 2 input from the GPS module 40 at the time of previous IG-OFF or the like and transmit the position information to the center server 100 via the DCM 90.

The DCM 90 is a communication device that bidirectionally communicates with the center server 100 over a predetermined communication network NW1 (for example, a mobile phone network including a plurality of base stations as terminations, or an Internet network). As described above, the DCM 90 is mutually communicatably connected to various ECUs such as the air conditioner ECU 60 and the engine ECU 80 over an in-vehicle network such as a CAN.

The center server 100 includes a communication device 110 and a processing device 120.

The communication device 110 is a device that bidirectionally communicates with the vehicle 2 (the DCM 90) and the terminal 200 over the communication networks NW1 and NW2 under the control of the processing device 120 (the communication processing unit 1201).

The processing device 120 executes various control processes in the center server 100. The function of the processing device 120 may be realized by any hardware, any software, or a combination thereof. For example, the processing device 120 may be mainly configured of one or more server computers each including a CPU, a RAM, a ROM, an I/O, or the like. The processing device 120 includes, for example, a communication processing unit 1201, a relay controller 1202, a vehicle position information acquisition unit 1203, a time information acquisition unit 1204, a degree-of-permission determination unit 1205, and an optimization controller 1206, as functional units that are realized by executing one or more programs stored in the ROM on the CPU. The processing device 120 includes, for example, an idling achievement DB 1209 that is recorded in a storage area defined in a storage device that is stored in or connected to a server computer.

The communication processing unit 1201 controls the communication device 110 to transmit and receive various signals (control signals, information signals, or the like) to and from the vehicle 2 and the terminal 200.

The relay controller 1202 relays various signals between the vehicle 2 and the terminal 200. Details will be described below.

The vehicle position information acquisition unit 1203 (an example of a position information acquisition unit) transmits a position information acquisition request for requesting acquisition of the position information of the vehicle 2 via the communication processing unit 1201, to acquire the position information of the vehicle 2 that is received from the vehicle 2, via the communication processing unit 1201.

The time information acquisition unit 1204 acquires information on the current time (time information) from a timer (not illustrated) included in the processing device 120, such as a real time clock (RTC).

The degree-of-permission determination unit 1205 (an example of an information generation unit) determines a degree of permission of idling at a time when a position and a startup request of the parked vehicle 2 have been transmitted, according to the position information of the vehicle 2 acquired by the vehicle position information acquisition unit 1203 and the time information acquired by the time information acquisition unit 1204. The degree of permission of idling is an index indicating a degree of permission in view of laws and regulations, a relationship with neighboring residents, or the like when idling of the engine 70 of the vehicle has been performed in a reasonable period (for example, within 10 minutes). In the embodiment, the degree of permission of idling is defined in four stages from level 1 at which the degree of permission is the highest to level 4 at which the degree of permission is the lowest.

The degree-of-permission determination unit 1205 determines the degree of permission of idling in consideration of a plurality of conditions in a comprehensive manner. The conditions to be taken into consideration may include, for example, a condition regarding whether or not a region is a target of laws and regulations in which idling is restricted (hereinafter referred to as a law and regulation condition). This is because no idling is permitted in a region in which idling is restricted by laws and regulations. Therefore, when a region is a target of the laws and regulations, the startup of the engine 70 of the vehicle based on the startup request is not permitted and the degree of permission of idling is relatively low, and when a region is not a target of the laws and regulations, the degree of permission of idling is relatively high.

Further, the conditions to be taken into consideration may include, for example, a condition regarding whether or not a region in which the vehicle 2 is parked is a residential area (hereinafter referred to as a residential area condition). This is because in the residential area, an influence on neighboring residents of noise due to idling or an exhaust gas of the vehicle 2 is large, and it tends to be difficult for the idling of the vehicle 2 to be permitted. Therefore, when the vehicle 2 is parked in the residential area, the degree of permission of idling becomes relatively low, and when the vehicle 2 is parked in a region other than the residential area, the degree of permission of idling becomes relatively high.

Further, for example, the conditions to be taken into consideration may include whether or not a time is a "nighttime" (for example, from 8 pm to 6 am on the next day, or the like) as a classification of a predetermined time period (nighttime condition). Since there is relatively no noise at nighttime, the noise due to the idling has a large influence on the neighboring residents, and it tends to be difficult for the idling of the vehicle 2 to be permitted. Therefore, when a time when the startup request is transmitted from the terminal 200 is the nighttime, the degree of permission of idling becomes relatively low, and when a time when the startup request is transmitted from the terminal 200 is a daytime, the degree of permission of idling becomes relatively high.

Further, for example, the conditions to be taken into consideration may include a condition as to whether or not the vehicle 2 is located in an indoor area of a closed space type garage of an individual, a multi-level parking lot, or the like (indoor area condition). This is because, when the vehicle 2 is idling in indoor area, an influence on people in the indoor area is large such as noise being echoed or an exhaust gas being accumulated in the indoor area, and it tends to be difficult for the idling of the vehicle 2 to be permitted. Therefore, when the vehicle 2 is parked in the indoor area, the degree of permission of idling becomes relatively low, and when the vehicle 2 is parked in a region other than the indoor area (outdoors), the degree of permission of idling becomes relatively high.

Further, for example, the conditions to be taken into consideration may include startup achievement (hereinafter also referred to as idling achievement) of the engine of the vehicle based on the startup request in the region in which the vehicle 2 is parked, that is, a condition (idling achievement condition) regarding a high or low startup achievement of the engine in the region by a plurality of vehicles that is a target of a remote startup service in the center server 100. This is because when the startup achievement of the engine of the vehicle by the remote startup service is high, it can be considered that the idling in the region can be permitted to some extent. Therefore, as the startup achievement of the engine of the vehicle by the remote startup service in a predetermined region in which the vehicle 2 is parked is higher, the degree of permission of idling becomes higher, and as the startup achievement of the engine of the vehicle is lower, the degree of permission of idling becomes lower.

When the degree-of-permission determination unit 1205 determines the idling achievement condition, the degree-of-permission determination unit 1205 may determine whether a startup achievement of the engine of the vehicle is high or low based on the data stored in the idling achievement DB 1209.

For example, the degree-of-permission determination unit 1205 may determine the degree of permission of idling based on, for example, a map defining which of level 1 to level 4 corresponds to the degree of permission in advance, for each of a plurality of combinations regarding whether or not the conditions described above are satisfied. For example, the degree-of-permission determination unit 1205 may define a score indicating a contribution to the degree of permission that is given according to whether or not the condition is satisfied for each of the conditions in a map or the like in advance, and determine the degree of permission of idling based on a total score that is given to all the conditions in such a manner that the degree of permission of idling is higher as the total score is higher.

The degree-of-permission determination unit 1205 transmits a notification regarding the determined degree of permission (degree-of-permission notification) to the optimization controller 1206 except for a case in which the determined degree of permission of idling is level 1. The degree-of-permission determination unit 1205 transmits the degree-of-permission notification including information on the degree of permission to the terminal 200 via the communication processing unit 1201.

The optimization controller 1206 (an example of the controller) performs optimization control to change a performance manner of the startup of the engine 70 of the vehicle based on the startup request transmitted from the terminal 200 based on the degree of permission determined by the degree-of-permission determination unit 1205. That is, the optimization controller 1206 changes a performance manner of the startup of the engine 70 of the vehicle so that it is easily to perform the startup of the engine 70 of the vehicle based on the startup request transmitted from the terminal 200 as the degree of permission of idling determined by the degree-of-permission determination unit 1205 increases, and it is less likely to perform the startup of the engine 70 of the vehicle based on the startup request transmitted from the terminal 200 as the degree of permission of idling determined by the degree-of-permission determination unit 1205 decreases. For example, when the degree of permission is relatively high level 1 or level 2, the optimization controller 1206 starts up the engine 70 of the vehicle as it is according to the startup request transmitted from the terminal 200. Further, for example, when the degree of permission is level 3, the optimization controller 1206 performs re-confirmation as to whether or not there is an intention to start up the engine 70 of the vehicle from the user in the terminal 200 after the transmission request is transmitted from the terminal 200. The optimization controller 1206 starts up the engine 70 of the vehicle for the first time when the re-confirmation can be made, that is, when a re-confirmation notification to be described below is received from the terminal 200 via the communication processing unit 1201. Further, for example, when the degree of permission is level 4, the optimization controller 1206 does not perform the startup of the engine 70 of the vehicle based on the transmission request. Details will be described below.

The idling achievement DB 1209 is a database regarding the achievement of the startup of the engine of the vehicle based on the startup request, which is performed for each of the vehicles that are targets of the remote startup service of the center server 100. Specifically, the idling achievement DB 1209 stores identification information (ID) of the vehicle in which the startup of the engine of the vehicle based on the startup request has been executed, position information of the vehicle when the startup of the engine of the vehicle has been performed, time information, and the like. The idling achievement DB 1209 also stores data obtained by statistically analyzing information on the startup of the engine of the vehicle based on the startup request each time. For example, the idling achievement DB 1209 also stores statistical data such as the number of times of startup (the number of vehicles that have been started up) in each time period for each predefined region classification.

The terminal 200 is, for example, a mobile terminal such as a smartphone or a tablet terminal carried by a user of the vehicle 2. The terminal 200 may be a stationary terminal carried by the user of the vehicle 2, such as a desktop type computer terminal. The terminal 200 includes a communication device 210, a processing device 220, a GPS module 230, and a touch panel display (hereinafter simply referred to as "display") 240.

The communication device 210 is a device that performs bidirectional communication with the center server 100 over a predetermined communication network NW2 (for example, a mobile phone network having a plurality of base stations as terminations, or the Internet network) under the control of the processing device 220 (specifically, a communication processing unit 2201 to be described below) and is, for example, a Long Term Evolution (LTE) module.

The processing device 220 performs various control processes in the terminal 200. The processing device 220 may be mainly configured of, for example, a computer including a CPU, a RAM, a ROM, an I/O and the like, and includes a communication processing unit 2201, a display controller 2202, and a remote operation unit 2203 as functional units that are realized by executing one or more programs stored in the ROM on the CPU.

The communication processing unit 2201 controls the communication device 210 and transmits and receives various signals to and from the center server 100.

The display controller 2202 displays various images on the display 240. For example, the display controller 2202 displays various graphical user interfaces (GUIs) as operation screens on the display 240.

The remote operation unit 2203 executes various processes regarding a remote operation of the engine 70 and the air conditioning device 10 of the vehicle according to a predetermined operation of the user with respect to a predetermined GUI displayed on the display 240 by the display controller 2202. A function of the remote operation unit 2203 becomes available, for example, by activating a predetermined application program (hereinafter referred to as "remote operation application") installed in the terminal 200 (the processing device 220) according to a predetermined operation of the user.

The remote operation unit 2203 transmits various signals regarding the remote operation of the vehicle 2 including a startup request for requesting the startup of the engine 70 and the air conditioning device 10 of the vehicle to the center server 100 via the communication processing unit 2201 according to a predetermined operation of the user with respect to the GUI. As described above, for example, a startup request transmitted to the center server 100 is transmitted to the vehicle 2 through relaying of the center server 100 (the relay controller 1202), and the engine 70 and the air conditioning device 10 of the vehicle are started up. The user can set various settings when operating the air conditioning device 10 on a predetermined GUI, and the remote operation unit 2203 transmits various signals such as a startup request including the various settings to the center server 100. As described above, in the vehicle 2, control of the air conditioning device 10 based on the setting content (for example, a set temperature as a requested value of the room temperature by the user, or a set operation time as a requested value of an operation time of the air conditioning device 10 by the user) is performed.

The remote operation unit 2203 (an example of a notification unit) displays a notification regarding the startup of the engine 70 of the vehicle based on the startup request on the display 240 via the display controller 2202 according to the degree of permission included in the degree-of-permission notification received from the center server 100 by the communication processing unit 2201. In this case, the remote operation unit 2203 changes the content of the notification so that the user easily decides to perform the startup of the engine 70 of the vehicle based on the startup request or decide to continue an idling state after the startup as the degree of permission of idling increases, and on the contrary, so that the user is difficult to perform the decision as the degree of permission of idling decreases. Hereinafter, a specific example of the notification regarding the startup of the engine 70 of the vehicle based on the startup request will be described with reference to FIG. 5 to FIG. 7.

Figure 5:
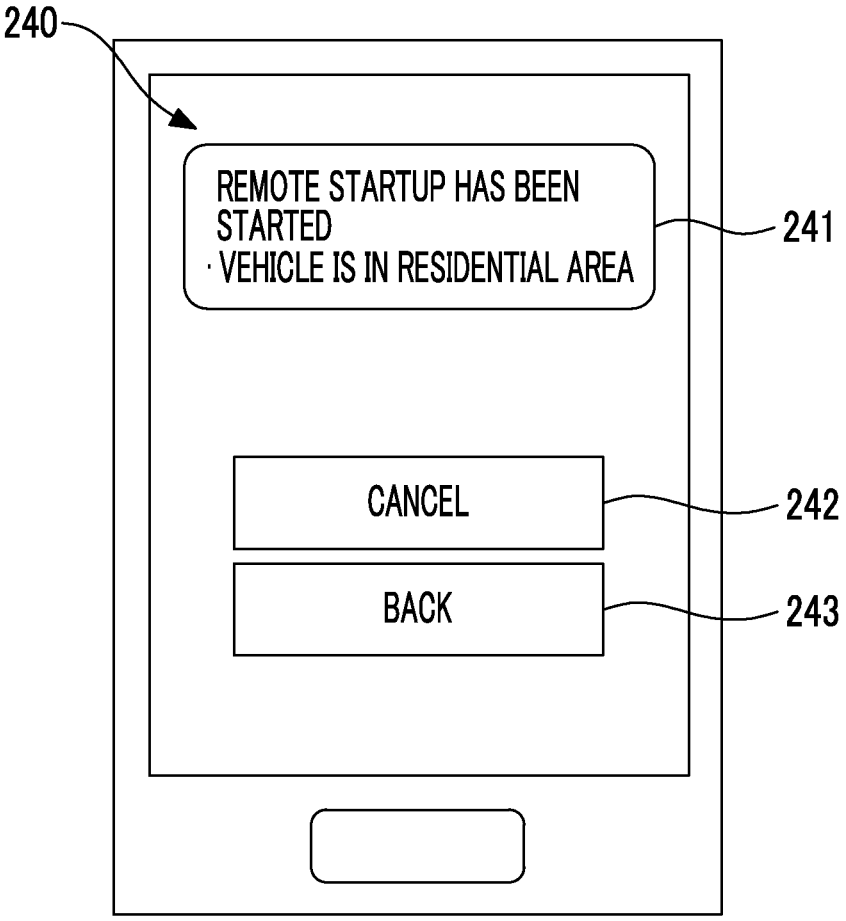
FIG. 5 is a diagram illustrating an example of a notification regarding startup of an engine of a vehicle based on a startup request.
Figure 6:
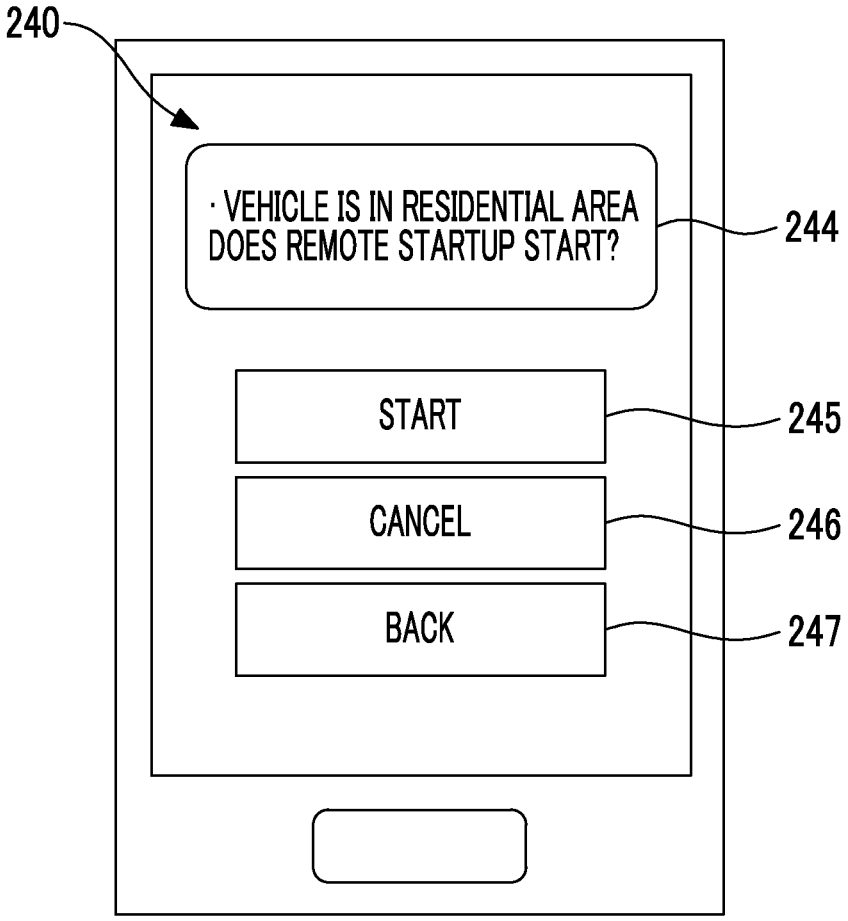
FIG. 6 is a diagram illustrating another example of the notification regarding the startup of the engine of the vehicle based on the startup request.
Figure 7:
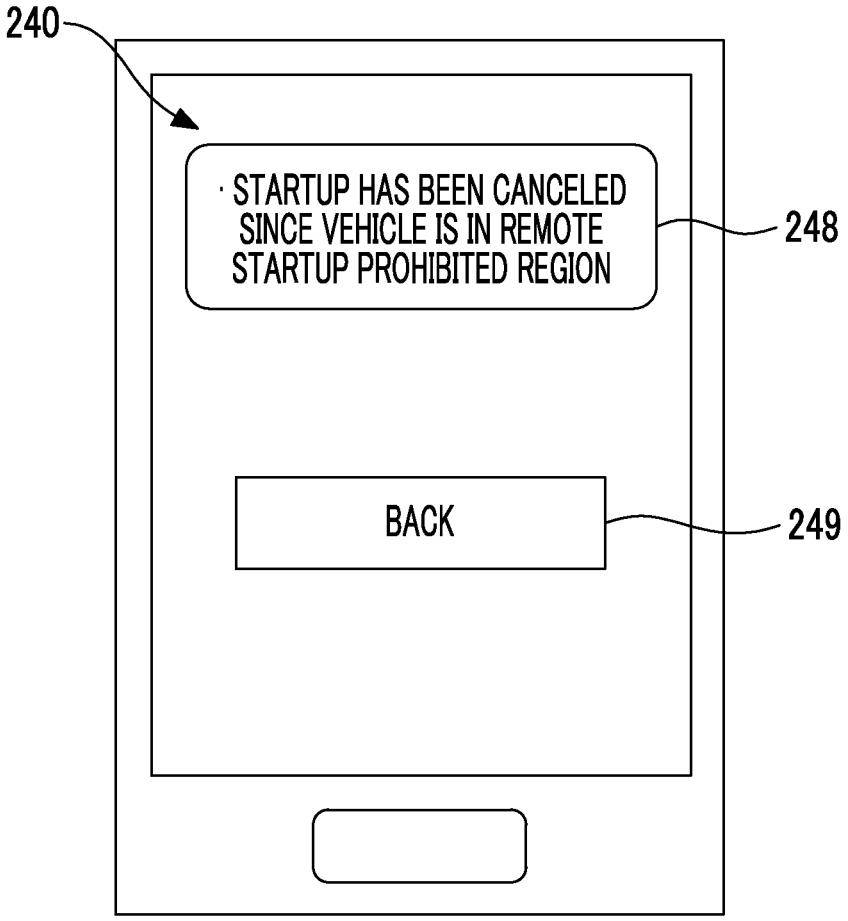
FIG. 7 is a diagram illustrating still another example of the notification regarding the startup of the engine of the vehicle based on the startup request.

FIGS. 5 to 7 are diagrams illustrating an example, another example, and still another example of a notification regarding the startup of the engine of the vehicle based on the startup request displayed on the display 240. Specifically, FIGS. 5 to 7 are specific examples of notifications when the degrees of permission included in the degree-of-permission notification received from the center server 100 by the communication processing unit 2201 are level 2 to level 4, respectively.

The degree of permission in this example is based on the following. The degree of permission is level 1 when the vehicle 2 is parked in a region other than the residential area and the startup request is transmitted during daytime in a region other than a target of the idling laws and regulations. The degree of permission is level 2 when the vehicle 2 is parked in a residential area or when a startup request is transmitted at nighttime in the region other than the target of the idling laws and regulations. The degree of permission is level 3 when the vehicle 2 is parked in the residential area and the startup request is transmitted at nighttime in the region other than the target of the idling laws and regulations. The degree of permission is level 4 when the startup request is transmitted in a time period that is a target of the laws and regulations of idling in the region that is a target of laws and regulations of idling.

As illustrated in FIG. 5, when the degree of permission is level 2, a comment indicating that the startup of the engine 70 of the vehicle based on the startup request has been performed, specifically, text information "Remote startup has been started" is displayed in a notification area 241 at an upper part of a screen of the display 240. In addition, a reason for having a degree of permission lower than level 1, that is, a comment indicating that the vehicle 2 is parked in the residential area, specifically, text information "Vehicle is in a residential area" is displayed in the notification area 241.

Virtual buttons 242 and 243 for receiving an operation of the user are displayed in the lower part of the screen of the display 240.

The button 242 is virtual operation means for canceling the idling of the engine 70 of the vehicle started up based on the startup request. Specifically, text information of "Cancel" is drawn. As described above, the user can confirm the reason for having a degree of permission lower than level 1 in the notification area 241, and immediately cancel the idling of the engine 70 of the vehicle when the user desires to cancel the idling of the engine 70 of the vehicle. In other words, using the degree of permission lower than level 1 as a trigger, the idling state of the engine 70 of the vehicle can be prompted to be canceled, making it difficult for the user to decide continuation of the idling state of the engine 70 of the vehicle.

The button 243 is virtual operation means for returning to a home screen of the remote operation application from the above screen. Specifically, text information "Back" is drawn.

As illustrated in FIG. 6, when the degree of permission is level 3, a reason for the degree of permission being level 3 lower than level 2 (in the present example, a part of the above reason), that is, a comment indicating that the vehicle 2 is parked in a residential area, specifically, text information "The vehicle is in a residential area" is displayed in a notification area 244 at the upper part of the screen of the display 240. In addition, a question to re-confirm whether the startup of the engine 70 of the vehicle based on the startup request is actually performed, specifically, text information "Does remote startup start?" is described in the notification area 244. By causing the user to ascertain the reason why the degree of permission in the notification area 244 is lower than the level 2 and the question for re-confirmation of whether to actually perform startup the engine 70 of the vehicle based on the startup request, it is possible to promptly cancel the startup of the engine 70 of the vehicle by operating the button 246 described below. In other words, using the degree of permission being lower than level 2 and a re-confirmation question having been notified as a trigger, cancelation of the startup of the engine 70 of the vehicle based on the startup request can be requested, and it is possible to make it further difficult for the user to decide continuation of the idling state of the engine 70 of the vehicle.

Virtual buttons 245 to 247 for receiving an operation of the user are displayed at a lower part of the screen of the display 240.

The button 245 is operation means for making a response indicating that the startup of the engine 70 of the vehicle based on the startup request is actually performed, to a question in the notification area 244. Specifically, text information "Start" is drawn. As described above, the user can cause the startup of the engine 70 of the vehicle based on the startup request to be performed by performing an operation with respect to the button 245.

The button 246 is operation means for responding to a question in the above-described notification area 244 in order to cancel the startup of the engine 70 of the vehicle based on the startup request. Specifically, text information "Cancel" is drawn. As described above, the user can cancel the startup of the engine 70 of the vehicle based on the startup request by operating the button 246.

The button 247 is virtual operation means for returning to the home screen of the remote operation application from the screen. Specifically, text information "Back" is drawn.

As illustrated in FIG. 7, when the degree of permission is level 4, a reason for the degree of permission being much lower than level 3, that is, a comment indicating that the vehicle 2 is parked in a target region of laws and regulations prohibiting the startup of the engine 70 of the vehicle based on the startup request (remote startup), and a comment indicating that the startup of the engine 70 of the vehicle based on the startup request has been forcibly canceled for the above reason, specifically, text information "The startup of the engine has been canceled since the vehicle is in a remote startup prohibited region" is displayed in a notification area 248 at the upper part of the screen of the display 240.

The button 249 is virtual operation means for returning to the home screen of the remote operation application from the screen. Specifically, text information "Back" is drawn.

As described above, in the embodiment, the remote operation unit 2203 changes the content of the notification displayed on the display 240 via the display controller 2202 so that the user is less likely to decide to perform the startup of the engine of the vehicle based on the startup request or decide to continue an idling state after the startup as the degree of permission of idling decreases.

Referring back to FIG. 1, for example, the GPS module 230 receives GPS signals transmitted from three or more satellites, preferably, four or more satellites over the terminal 200, and measures the position of the terminal 200 on which the GPS module 230 is mounted. Position information of the terminal 200 of which the position has been measured is input to the processing device 220.

The position information of the terminal 200 may be acquired through base station position measurement based on signal exchange with the base station instead of or in addition to the GPS position measurement by the GPS module 230.

Details of Operation of Remote Startup System

A specific operation of the remote startup system 1 will be described with reference to FIGS. 8 to 11.

Figure 8:
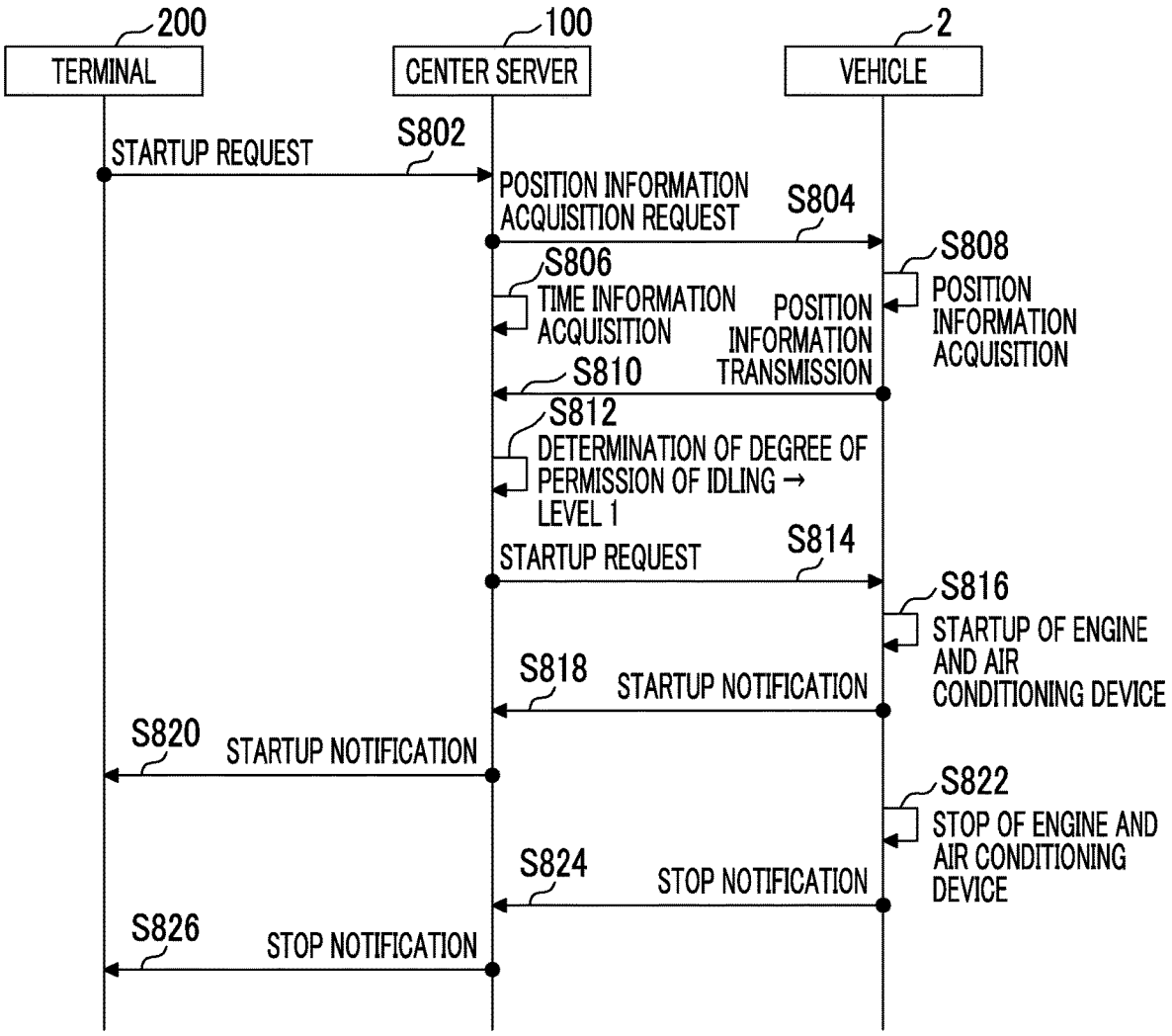
FIG. 8 is a sequence diagram schematically illustrating a first example of an operation of the remote startup system.

FIG. 8 is a sequence diagram schematically illustrating a first example of the operation of the remote startup system 1 according to the embodiment. Specifically, FIG. 8 is a diagram illustrating a specific example of the operation of the remote startup system 1 when the degree of permission of idling is determined to be level 1.

In step S802, the remote operation unit 2203 of the terminal 200 transmits a startup request including various setting content (set temperature, set operation time, and the like) to the center server 100 via the communication processing unit 2201 according to a predetermined operation with respect to the GUI by the user.

In step S804, when the startup request is received from the terminal 200 by the communication processing unit 1201 in step S802, the vehicle position information acquisition unit 1203 of the center server 100 transmits a position information acquisition request to the vehicle 2 via the communication processing unit 1201.

In step S806, the time information acquisition unit 1204 of the center server 100 acquires time information from a timer of the center server 100.

On the other hand, in step S808, when the position information acquisition request is received from the center server 100 by the DCM 90, the position information transmission unit 803 of the vehicle 2 acquires the position information of the vehicle 2 from the GPS module 40.

In step S810, the position information transmission unit 803 of the vehicle 2 transmits the position information of the vehicle 2 to the center server 100 via the DCM 90.

In step S810, the vehicle position information acquisition unit 1203 of the center server 100 acquires the position information of the vehicle 2 received by the communication processing unit 1201. Then, in step S812, the degree-of-permission determination unit 1205 of the center server 100 determines the degree of permission of idling based on the position information of the vehicle 2 and the time information acquired by the vehicle position information acquisition unit 1203 and the time information acquisition unit 1204. In this example, the degree-of-permission determination unit 1205 determines the degree of permission of idling to be level 1.

In step S814, the optimization controller 1206 of the center server 100 confirms that the degree of permission of idling is level 1, and transmits a startup request to the vehicle 2 via the communication processing unit 1201.

In step S816, when the startup request is received from the center server 100 by the DCM 90, the remote operation assistance controller 802 of the vehicle 2 transmits an engine startup request and an air conditioning startup request to the engine controller 801 and the air conditioner ECU 60 to start up the engine 70 and the air conditioning device 10 of the vehicle.

In step S818, the remote operation assistance controller 802 of the vehicle 2 transmits a startup notification indicating that the engine 70 and the air conditioning device 10 of the vehicle have been started up to the center server 100 via the DCM 90.

In step S820, when the startup notification is received from the vehicle 2 by the communication processing unit 1201, the relay controller 1202 of the center server 100 transfers the startup notification to the terminal 200 via the communication processing unit 1201.

Meanwhile, in step S822, when an end condition is satisfied after the engine 70 of the vehicle has been started up, the remote operation assistance controller 802 of the vehicle 2 transmits an engine stop request and an air conditioning stop request to the engine controller 801 and the air conditioner ECU 60 to stop the engine 70 and the air conditioning device 10 of the vehicle.

In step S824, the remote operation assistance controller 802 of the vehicle 2 transmits a stop notification indicating that the engine 70 and the air conditioning device 10 of the vehicle have been stopped to the center server 100 via the DCM 90.

In step S826, when the stop notification is received from the vehicle 2 by the communication processing unit 1201, the relay controller 1202 of the center server 100 transfers the stop notification to the terminal 200 via the communication processing unit 1201.

Figure 9A:
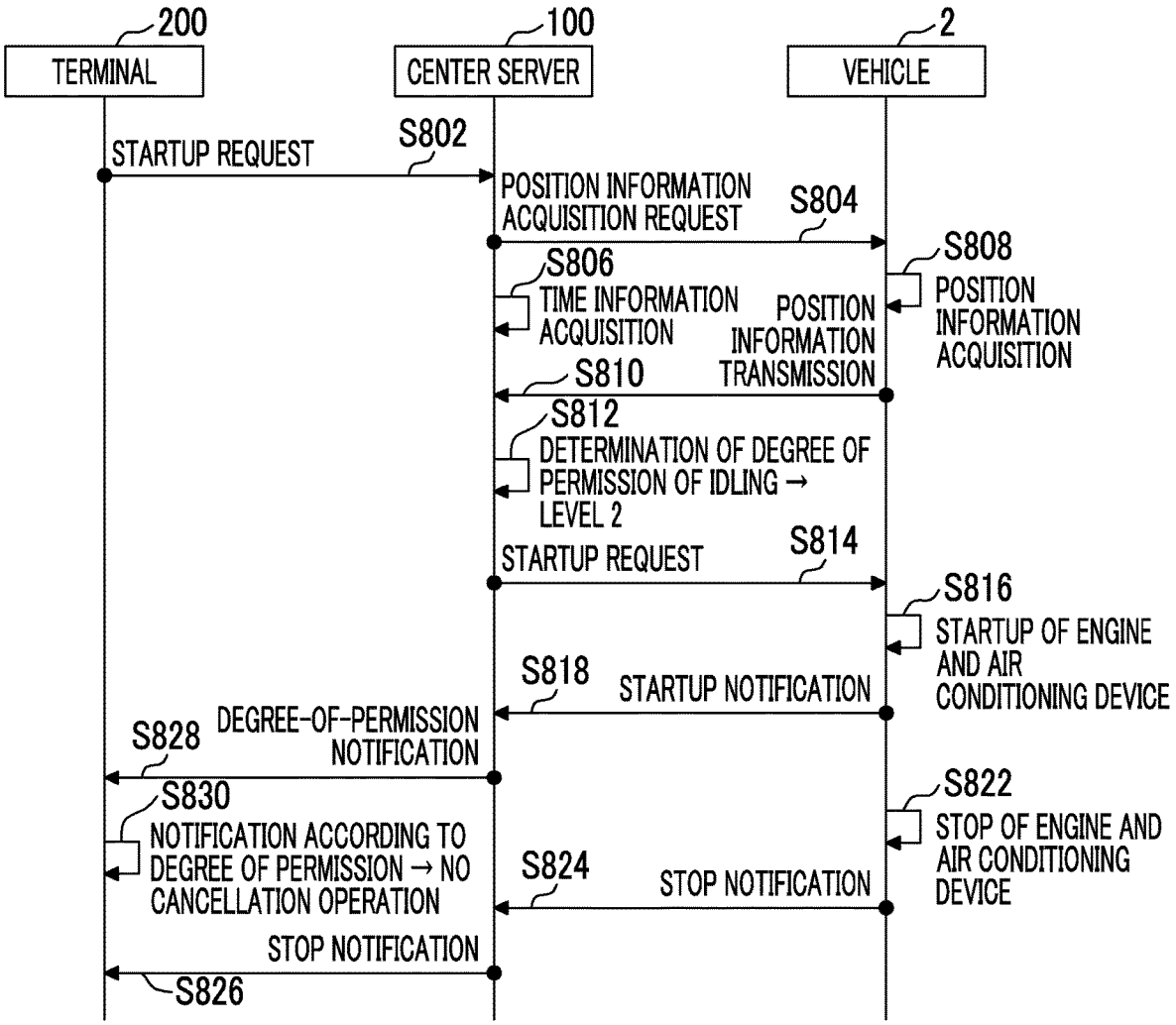
FIG. 9A is a sequence diagram schematically illustrating a second example of the operation of the remote startup system.
Figure 9B:
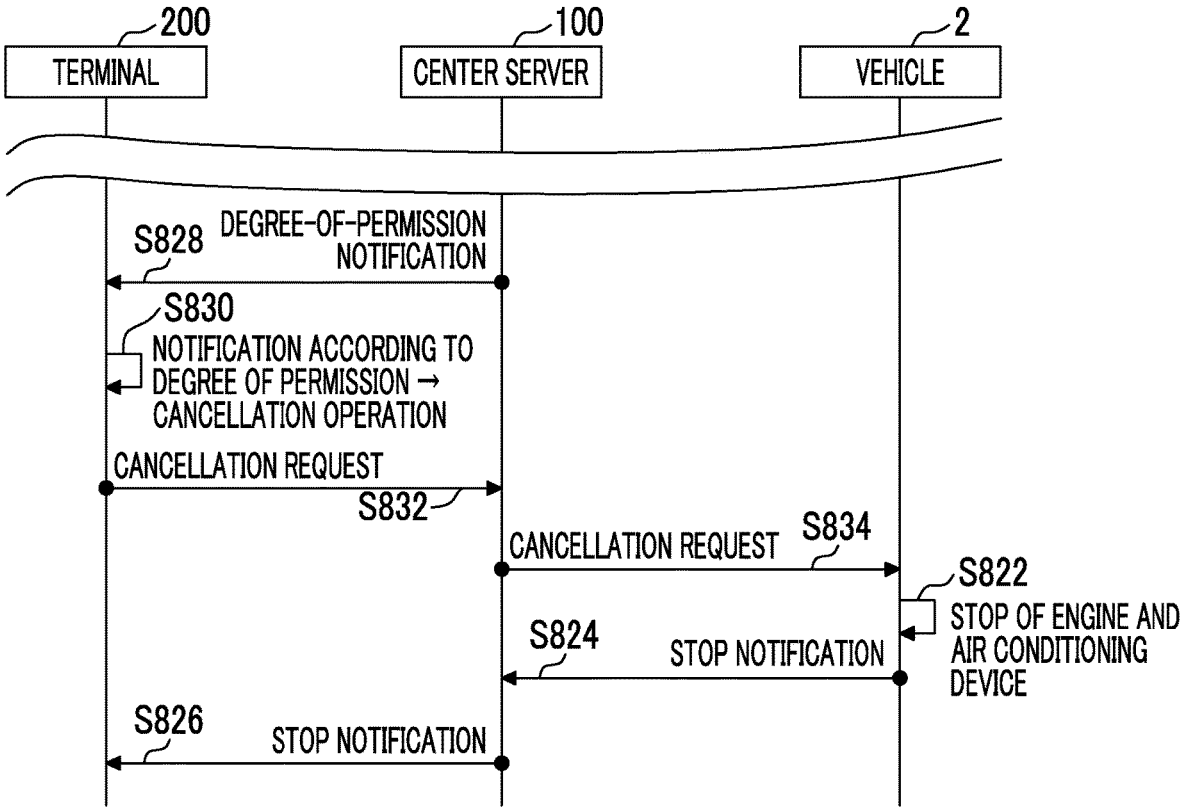
FIG. 9B is a sequence diagram schematically illustrating the second example of the operation of the remote startup system.

FIGS. 9A and 9B are sequence diagrams schematically illustrating a second example of the operation of the remote startup system 1 according to the embodiment. Specifically, FIGS. 9A and 9B are diagrams illustrating a specific example of the operation of the remote startup system 1 when the degree of permission of idling is determined to be level 2. More specifically, FIG. 9A is a diagram illustrating a specific example of an operation of the remote startup system 1 when an operation for canceling the idling of the engine 70 of the vehicle is not performed with respect to the button 242 on the screen illustrated in FIG. 5 in a case in which the degree of permission of idling is determined to be level 2. FIG. 9B is a diagram illustrating a specific example of the operation of the remote startup system 1 when an operation for canceling idling of the engine 70 of the vehicle is performed with respect to the button 242 in a case in which the degree of permission of the idling is determined to be level 2.

The same step number is assigned to the same process as in the sequence diagram illustrated in FIG. 8. The processes of steps S802 to S816 are also omitted in FIG. 9B since the processes are the same as in FIG. 9A when the operation of canceling the idling of the engine 70 of the vehicle is performed.

As illustrated in FIG. 9A, since the processes of steps S802 to S810 are the same as those in FIG. 8, description thereof will be omitted.

In step S810, the vehicle position information acquisition unit 1203 of the center server 100 acquires the position information of the vehicle 2 received by the communication processing unit 1201. Then, in step S812, the degree-of-permission determination unit 1205 of the center server 100 determines the degree of permission of idling based on the position information of the vehicle 2 and the time information acquired by the vehicle position information acquisition unit 1203 and the time information acquisition unit 1204. In this example, the degree-of-permission determination unit 1205 determines the degree of permission of idling to be level 2.

In step S814, the optimization controller 1206 of the center server 100 confirms that the degree of permission of idling is level 2, and transmits a startup request to the vehicle 2 via the communication processing unit 1201.

In step S816, when the startup request is received from the center server 100 by the DCM 90, the remote operation assistance controller 802 of the vehicle 2 transmits an engine startup request and an air conditioning startup request to the engine controller 801 and the air conditioner ECU 60 to start up the engine 70 and the air conditioning device 10 of the vehicle.

In step S818, the remote operation assistance controller 802 of the vehicle 2 transmits a startup notification indicating that the engine 70 and the air conditioning device 10 of the vehicle have been started up to the center server 100 via the DCM 90.

In step S828, when the startup notification is received from the vehicle 2 by the communication processing unit 1201, the degree-of-permission determination unit 1205 of the center server 100 transmits a degree-of-permission notification including the degree of permission of idling to the terminal 200 via the communication processing unit 1201 according to the fact that the degree of permission of idling is level 2.

In step S830, when the degree-of-permission notification is received from the center server 100 by the communication processing unit 2201, the remote operation unit 2203 of the terminal 200 displays a notification regarding the startup of the engine 70 of the vehicle based on the startup request on the display 240 via the display controller 2202 according to the degree of permission of idling included in the degree-of-permission notification. For example, as described above, the remote operation unit 2203 causes the display 240 to display the notification screen illustrated in FIG. 5 described above via the display controller 2202. In this example, an operation with respect to the button 242 for canceling the idling of the engine 70 of the vehicle on the notification screen illustrated in FIG. 5 is not performed.

Thereafter, after the startup of the engine 70 of the vehicle, the processes of steps S822 to S826 are performed according to satisfaction of a predetermined end condition. Since the processes in steps S822 to S826 are the same as in FIG. 8, description thereof will be omitted.

On the other hand, as illustrated in FIG. 9B, in step S828, the remote operation unit 2203 of the terminal 200 displays the notification screen illustrated in FIG. 5 described above on the display 240 via the display controller 2202. In this example, an operation with respect to the button 242 for canceling the idling of the engine 70 of the vehicle on the notification screen illustrated in FIG. 5 is performed.

In step S832, the remote operation unit 2203 of the terminal 200 transmits a cancelation notification for canceling the idling of the engine 70 of the vehicle to the center server 100 via the communication processing unit 2201 according to the operation with respect to the button 242.

In step S834, when the cancelation request is received from the terminal 200 by the communication processing unit 1201, the relay controller 1202 of the center server 100 transfers the cancelation request to the vehicle 2 via the communication processing unit 1201.

In step S822, in the remote operation assistance controller 802 of the vehicle 2, when the cancelation request is received from the center server 100 via the DCM 90, the end condition is satisfied. The remote operation assistance controller 802 stops the engine 70 and the air conditioning device 10 of the vehicle by transmitting the engine stop request and the air conditioning stop request to the engine controller 801 and the air conditioner ECU 60, respectively.

Thereafter, since the processes of steps S824 and S826 are the same as those in FIG. 8 and the like, description thereof will be omitted.

Figure 10A:
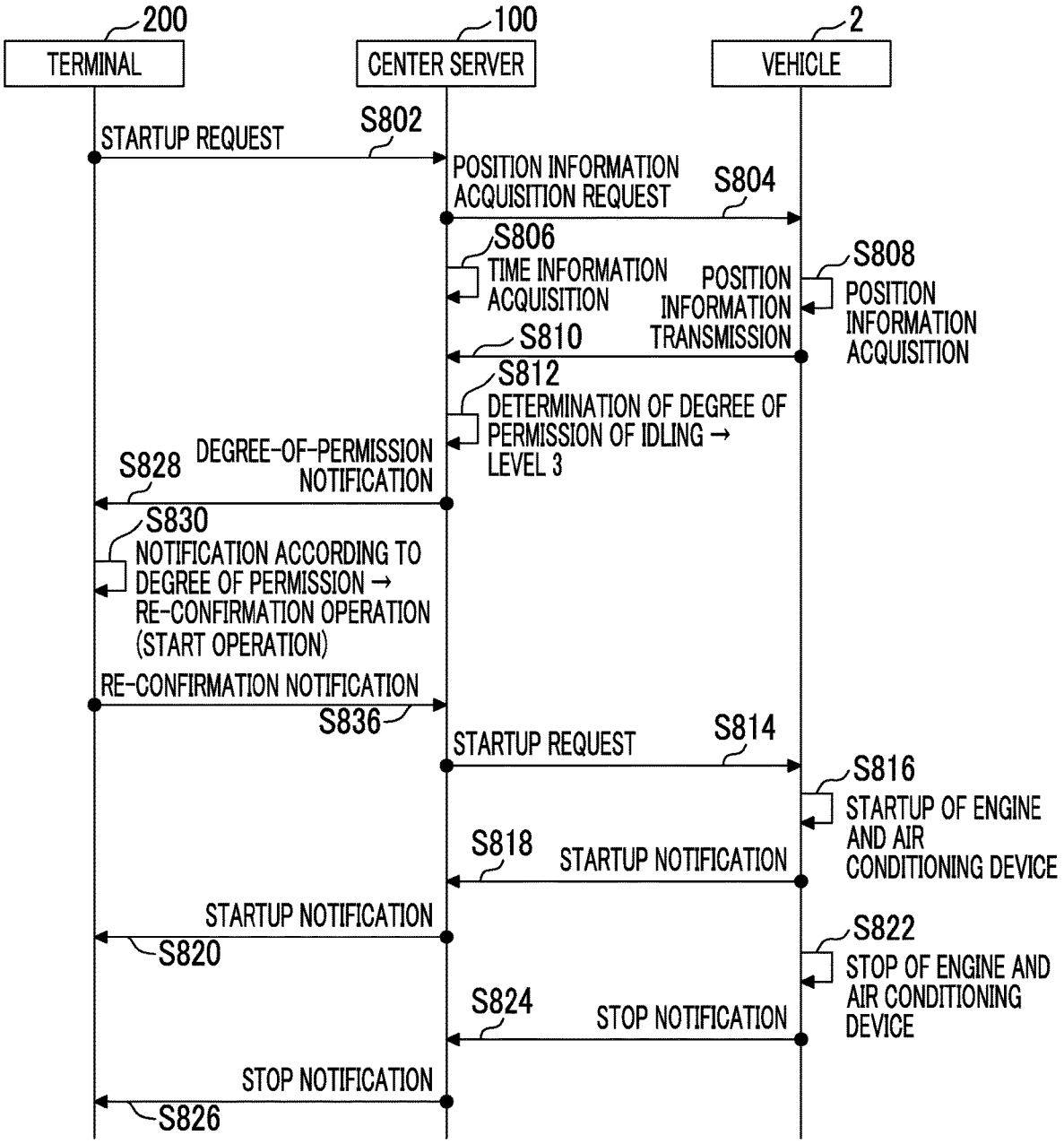
FIG. 10A is a sequence diagram schematically illustrating a third example of the operation of the remote startup system.
Figure 10B:
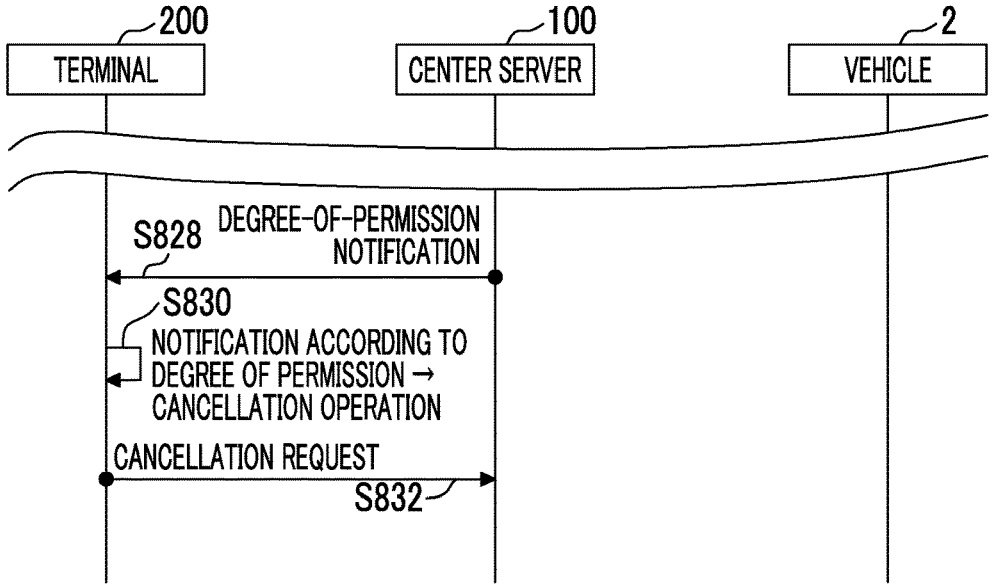
FIG. 10B is a sequence diagram schematically illustrating the third example of the operation of the remote startup system.

FIGS. 10A and 10B are sequence diagrams schematically illustrating a third example of the operation of the remote startup system 1 according to the embodiment. Specifically, FIGS. 10A and 10B are specific examples of the operation of the remote startup system 1 when the degree of permission of idling is determined to be level 3. More specifically, FIG. 10A is a diagram illustrating a specific example of an operation of the remote startup system 1 when a re-confirmation operation for performing startup of the engine 70 of the vehicle based on the startup request is performed with respect to the button 245 on the screen illustrated in FIG. 6 described above in a case in which the degree of permission of idling is determined to be level 3. FIG. 10B is a diagram illustrating a specific example of the operation of the remote startup system 1 when an operation for canceling the startup of the engine 70 of the vehicle based on the startup request is performed with respect to the button 246 of the screen illustrated in FIG. 6 described above in a case in which the degree of permission of the idling is determined to be level 3.

The same step number is assigned to the same process as that in the sequence diagram illustrated in FIG. 8 and the like. Processes of steps S802 to S810 will also be omitted in FIG. 10B since the processes are the same as those in FIG. 10A even when the operation for canceling the startup of the engine 70 of the vehicle based on the startup request is performed.

As illustrated in FIG. 10A, since the processes of steps S802 to S810 are the same as those in FIG. 8 and the like, description thereof will be omitted.

In step S810, the vehicle position information acquisition unit 1203 of the center server 100 acquires the position information of the vehicle 2 received by the communication processing unit 1201. Then, in step S812, the degree-of-permission determination unit 1205 of the center server 100 determines the degree of permission of idling based on the position information of the vehicle 2 and the time information acquired by the vehicle position information acquisition unit 1203 and the time information acquisition unit 1204. In this example, the degree-of-permission determination unit 1205 determines the degree of permission of idling to be level 3.

In step S828, the degree-of-permission determination unit 1205 of the center server 100 transmits a degree-of-permission notification including the degree of permission of idling to the terminal 200 via the communication processing unit 1201 according to the fact that the degree of permission of idling is level 3.

In step S830, when the degree-of-permission notification is received from the center server 100 by the communication processing unit 2201, the remote operation unit 2203 of the terminal 200 displays a notification regarding the startup of the engine 70 of the vehicle based on the startup request on the display 240 via the display controller 2202 according to the degree of permission of idling included in the degree-of-permission notification. For example, as described above, the remote operation unit 2203 causes the display 240 to display the notification screen illustrated in FIG. 6 described above via the display controller 2202. In this example, an operation (re-confirmation operation) with respect to the button 245 for performing the startup of the engine 70 of the vehicle based on the startup request on the notification screen illustrated in FIG. 6 is performed.

In step S836, the remote operation unit 2203 of the terminal 200 transmits a re-confirmation notification indicating that the re-confirmation operation has been performed to the center server 100 via the communication processing unit 2201.

In step S814, when the re-confirmation notification is received from the terminal 200 by the communication processing unit 1201, the optimization controller 1206 of the center server 100 transmits a startup request to the vehicle 2 via the communication processing unit 1201.

Subsequently, since the processes of steps S816 to S826 are the same as those of FIG. 8, description thereof will be omitted.

On the other hand, as illustrated in FIG. 10B, in step S828, the remote operation unit 2203 of the terminal 200 displays a notification screen illustrated in FIG. 6 on the display 240 via the display controller 2202. In this example, an operation with respect to the button 246 for canceling the startup of the engine 70 of the vehicle based on the startup request on the notification screen illustrated in FIG. 6 is performed.

In step S832, the remote operation unit 2203 of the terminal 200 transmits a cancelation notification for canceling the startup of the engine 70 of the vehicle based on the startup request to the center server 100 via the communication processing unit 2201 according to the operation with respect to the button 246. Therefore, by receiving the cancelation notification, the center server 100 cancels the startup of the vehicle 2 based on the startup request transmitted from the terminal 200 to the center server 100 in step S802, and does not perform transfer of the startup request to the vehicle 2.

Figure 11:
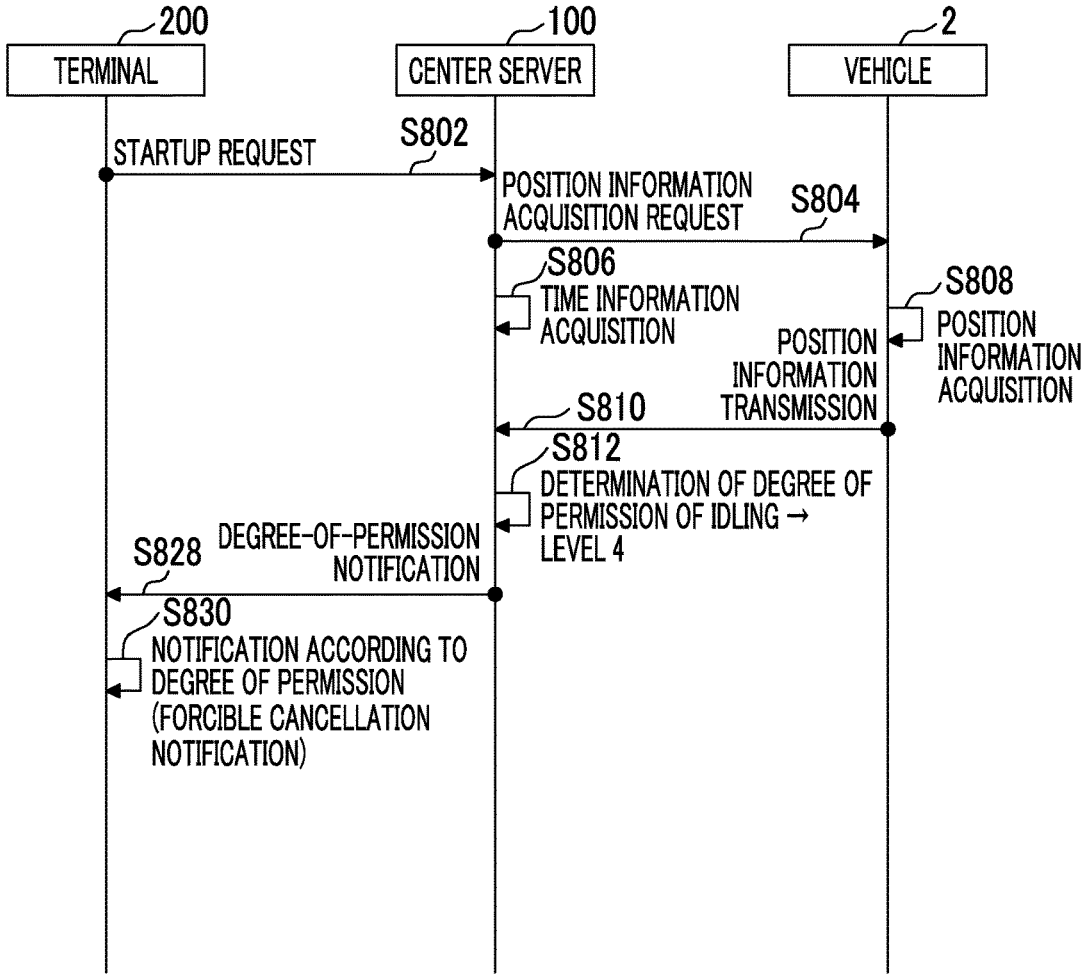
FIG. 11 is a sequence diagram schematically illustrating a fourth example of the operation of the remote startup system.

FIG. 11 is a sequence diagram schematically illustrating a fourth example of the operation of the remote startup system 1 according to the embodiment. Specifically, FIG. 11 illustrates a specific example of the operation of the remote startup system 1 when the degree of permission of idling is determined to be level 4.

The same step number is assigned to the same process as in the sequence diagram illustrated in FIG. 8 and the like.

As illustrated in FIG. 11, since the processes of steps S802 to S810 are the same as those in FIG. 8 and the like, description thereof will be omitted.

In step S810, the vehicle position information acquisition unit 1203 of the center server 100 acquires the position information of the vehicle 2 received from the communication processing unit 1201. Then, in step S812, the degree-of-permission determination unit 1205 of the center server 100 determines the degree of permission of idling based on the position information of the vehicle 2 and the time information acquired by the vehicle position information acquisition unit 1203 and the time information acquisition unit 1204. In this example, the degree-of-permission determination unit 1205 determines the degree of permission of idling to be level 4.

In step S828, the degree-of-permission determination unit 1205 of the center server 100 transmits a degree-of-permission notification including the degree of permission of idling to the terminal 200 via the communication processing unit 1201 according to the fact that the degree of permission of idling is level 4.

In step S830, when the degree-of-permission notification is received from the center server 100 by the communication processing unit 2201, the remote operation unit 2203 of the terminal 200 displays a notification regarding the startup of the engine 70 of the vehicle based on the startup request on the display 240 via the display controller 2202 according to the degree of permission of idling included in the degree-of-permission notification. For example, as described above, the remote operation unit 2203 displays a notification screen illustrated in FIG. 7 described above, that is, a notification indicating that the startup of the engine 70 of the vehicle based on the startup request has been forcibly canceled (Forcible cancelation notification) on the display 240 via the display controller 2202.

As described above, in the embodiment, when a startup request is transmitted from the terminal 200 to the center server 100, the optimization controller 1206 changes the performance manner of the startup of the engine 70 of the vehicle based on the startup request according to the position information of the vehicle 2 and the time information acquired by the vehicle position information acquisition unit 1203 and the time information acquisition unit 1204. As described above, in the performance manner, for example, whether or not the startup of the engine 70 of the vehicle is permitted, and a performance procedure when the startup is permitted are included. As described above, for example, the startup of the engine 70 of the vehicle can be prohibited in a region in which idling is prohibited in a time period to which a time determined by laws and regulations belongs or the engine 70 of the vehicle can be started up on condition that a procedure for re-confirmation as to whether the startup is desired to be really performed is made after the startup request is transmitted in a residential area at nighttime in a region that is not a target of the laws and regulations. Therefore, even when the user is at a position relatively separated from the vehicle 2, the engine 70 of the vehicle can be started up in consideration of environmental conditions of the parked vehicle 2.

In the embodiment, as a performance manner of the startup of the engine 70 of the vehicle, not only whether or not the startup of the engine 70 of the vehicle is permitted, but also a performance procedure when the startup is permitted is changed, but solely whether or not the startup of the engine 70 of the vehicle is permitted may be changed. For example, a manner in which when the degree of permission of idling is level 1 or 2, the engine 70 of the vehicle is started up solely by transmitting a startup request from the terminal 200, and when the degree of permission of idling is levels 3 and 4, the startup of the engine 70 of the vehicle according to the transmission of the startup request from the terminal 200 is inhibited may be adopted.

In the embodiment, the degree-of-permission determination unit 1205 determines the degree of permission of idling of the engine 70 of the vehicle at a time when the position of the vehicle 2 and the startup request are transmitted, according to the position information of the vehicle 2 and the time information. The optimization controller 1206 changes the performance manner of the startup of the engine 70 of the vehicle based on the startup request so that the startup of the engine 70 of the vehicle based on the startup request is less likely to be performed as the degree of permission is lower. As described above, the degree-of-permission determination unit 1205 can determine the degree of permission to be low in a situation in which the idling is less likely to be permitted, such as a case in which the vehicle 2 is parked in a quiet residential area or a case in which a current time is nighttime. Therefore, it is possible to make it less likely to perform remote startup of the engine 70 of the vehicle based on the startup request in a situation in which idling is less likely to be permitted.

In the embodiment, the optimization controller 1206 changes the performance manner of the startup of the engine 70 of the vehicle based on the startup request so that the startup of the engine 70 of the vehicle based on the startup request is less likely to be performed in a case in which the time information indicates nighttime, as compared with a case in which the time information indicates daytime. As described above, it is possible to make it less likely to perform idling at nighttime when an influence on the neighboring residents is large.

In the embodiment, the optimization controller 1206 changes the performance manner of the startup of the engine 70 based on the startup request so that the startup of the engine 70 based on the startup request is less likely to be performed in a case in which the position information of the vehicle 2 indicates the residential area or the indoor area, as compared with a case in which the position information indicates neither a residential area nor an indoor area. As described above, it is possible to make it less likely to perform idling in the indoor area that is not desirable from the viewpoint of residential areas having a large influence on neighboring residents, fullness of exhaust gas, or echoes of noise.

In the embodiment, the optimization controller 1206 changes a performance manner of the startup of the engine 70 of the vehicle based on the startup request so that the startup of the engine 70 of the vehicle based on the startup request of the vehicle 2 is easily performed as achievement of the startup of the engine of the vehicle based on a startup request of a plurality of vehicles that is a target of a remote startup service by the center server 100 in the region corresponding to the position information of the vehicle 2 is higher. Since it is considered that there is no problem even when idling is performed in the region in which the vehicle 2 is parked as startup achievement (idling achievement) of the engine of the vehicle based on the startup request of the vehicles in the region in which the vehicle 2 is parked is higher, the remote startup of the engine 70 of the vehicle is easily remotely performed. Therefore, it is possible to start up the engine 70 of the vehicle in consideration of the environmental conditions of the parked vehicle 2 in a more practical manner based on the idling achievement.

In the embodiment, when the startup request is transmitted from the terminal 200 to the center server 100, the remote operation unit 2203 displays a notification regarding the performance of the startup of the engine 70 of the vehicle based on the startup request on the display 240 via the display controller 2202. The remote operation unit 2203 changes content of the notification according to the position information of the vehicle 2 and the time information acquired by the vehicle position information acquisition unit 1203 and the time information acquisition unit 1204. As described above, the remote operation unit 2203, for example, can perform a notification indicating that the startup of the engine 70 of the vehicle cannot be performed in a region in which idling is prohibited in a time period to which a time determined by laws and regulations belongs or perform a notification of re-confirmation as to whether the startup is desired to be really performed after the startup request is transmitted in a residential area at nighttime in a region that is not a target of the laws and regulations. Therefore, even when the user is at a position relatively separated from the vehicle 2, the user can appropriately decide environmental conditions of the parked vehicle 2, and thus, can start up the engine 70 of the vehicle in consideration of the environmental conditions.

In the embodiment, the remote operation unit 2203 changes the content of the notification so that the user is less likely to decide to perform the startup of the engine 70 of the vehicle based on the startup request or decide to continue an idling state after the startup as the degree of permission of idling determined by the degree-of-permission determination unit 1205 decreases. As described above, the degree-of-permission determination unit 1205 can determine the degree of permission to be low in a situation in which the idling is less likely to be permitted, such as a case in which the vehicle 2 is parked in a quiet residential area or a case in which a current time is nighttime. Therefore, for example, in a situation in which the idling is less likely to be permitted, the remote operation unit 2203 can perform a notification to re-confirm whether the startup of the engine 70 of the vehicle is desired to be really performed after transmission of the startup request or can perform a notification indicating that the startup of the engine of the vehicle can be canceled after the startup of the engine 70 of the vehicle so that the user is less likely to decide to perform the startup of the engine 70 of the vehicle or decide to continue an idling state of the engine 70 of the vehicle. Therefore, it is possible to suppress the remote startup of the engine 70 of the vehicle in a situation in which the idling is less likely to be permitted or to suppress the continuation of the idling state of the engine 70 of the vehicle.

In the embodiment, the remote operation unit 2203 changes content of the notification so that the user is less likely to decide to perform the startup of the engine 70 of the vehicle based on the startup request or decide to continue an idling state after the startup in a case in which the time information indicates nighttime, as compared with a case in which the time information indicates daytime. As described above, it is possible to suppress the remote startup of the engine 70 of the vehicle, the continuation of the idling state, and the like at nighttime when the influence on the neighboring residents is large.

In the embodiment, the remote operation unit 2203 changes content of the notification so that a user is less likely to decide to perform the startup of the engine 70 of the vehicle based on the startup request or decide to continue an idling state after the startup in a case in which the position information indicates the residential area or the indoor area, as compared with a case in which the position information indicates neither a residential area nor an indoor area. As described above, it is possible to suppress, for example, the remote startup of the engine 70 of the vehicle or the continuation of the idling state in the indoor area that is not desirable from the viewpoint of residential areas having a large influence on neighboring residents, fullness of exhaust gas, or echoes of noise.

The remote operation unit 2203 changes the content of the notification so that the user easily decides to perform the startup of the engine 70 of the vehicle based on the startup request of the vehicle 2 or decide to continue an idling state after the startup as achievement of the startup of the engine of the vehicle based on a startup request of a plurality of vehicles that is a target of a remote startup service by the center server 100 in the region corresponding to the position information of the vehicle 2 is higher. As described above, since it is considered that there is no problem even when idling is performed in the region in which the vehicle 2 is parked as startup achievement (idling achievement) of the engine of the vehicle based on the startup request in the region is higher, the user easily decides to remotely start up the engine 70 of the vehicle or decide to continue an idling state after the start. Therefore, it is possible to start up the engine 70 of the vehicle in consideration of the environmental conditions of the parked vehicle 2 in a more practical manner based on the idling achievement.

In the embodiment, the functions of the vehicle position information acquisition unit 1203, the time information acquisition unit 1204, the degree-of-permission determination unit 1205, and the optimization controller 1206 are provided in the center server 100, but the functions may be provided in the vehicle 2 or the functions may be provided in the terminal 200.

Although the embodiments for carrying out the present disclosure have been described in detail above, the present disclosure is not limited to the above-described specific embodiments, and various modifications and changes can be performed within the scope of the present disclosure described in the claims.

What is claimed is:

1. A remote startup system including a terminal of a user, a center server that is configured to communicate with the terminal, and a vehicle that is configured to communicate with the center server, the remote startup system being configured to start up an engine of the vehicle according to a startup request transmitted from the terminal to the center server, the remote startup system comprising:

a position information acquisition unit configured to acquire position information of the vehicle;

a time information acquisition unit configured to acquire time information;

a controller configured to change a performance manner of the startup of the engine based on the startup request including whether the startup of the engine is permitted according to the position information of the vehicle and the time information when the startup request is transmitted from the terminal to the center server; and a degree-of-permission determination unit configured to determine a degree of permission of idling of the engine at a time when a position of the vehicle and the startup request are transmitted, according to the position information and the time information, wherein the controller is configured to change the performance manner such that the startup of the engine based on the startup request is less likely to be performed as the degree of permission is lower, and wherein the controller is configured to perform re-confirmation as to whether or not there is an intention to start up the engine of the vehicle from the user when the degree of permission is higher than a predetermined level.

2. The remote startup system according to claim 1, wherein the controller is configured to change the performance manner such that the startup of the engine based on the startup request is less likely to be performed in a case in which the time information indicates nighttime, as compared with a case in which the time information indicates daytime.

3. The remote startup system according to claim 1, wherein the controller is configured to change the performance manner such that the startup of the engine based on the startup request is less likely to be performed in a case in which the position information indicates a residential area or an indoor area, as compared with a case in which the position information indicates neither the residential area nor the indoor area.

4. The remote startup system according to claim 1, wherein:

a plurality of vehicles is provided; and the controller is configured to change the performance manner such that the startup of the engine based on the startup request of one of the vehicles is easily performed as achievement of the startup of the engine based on a startup request of the vehicles in a region corresponding to the position information is higher.

5. A remote startup system including a terminal of a user, a center server that is configured to communicate with the terminal, and a vehicle that is configured to communicate with the center server, the remote startup system being configured to start up an engine of the vehicle according to a startup request transmitted from the terminal to the center server, the remote startup system comprising:

a position information acquisition unit configured to acquire position information of the vehicle;

a time information acquisition unit configured to acquire time information;

a notification unit provided in the terminal, the notification unit being configured to perform notification regarding performance of startup of the engine based on the startup request when the startup request is transmitted from the terminal to the center server; and a degree-of-permission determination unit configured to determine a degree of permission of idling of the engine at a time when a position of the vehicle and the startup request are transmitted, according to the position information and the time information, and wherein the notification unit is configured to change content of the notification according to the position information of the vehicle and the time information, and wherein the notification unit is configured to change content of the notification such that the user is less likely to decide to perform the startup of the engine based on the startup request or decide to continue an idling state after the startup as the degree of permission is lower, and wherein the notification unit is configured to perform re-confirmation as to whether or not there is an intention to start up the engine of the vehicle from the user when the degree of permission is higher than a predetermined level.

6. The remote startup system according to claim 5, wherein the notification unit is configured to change content of the notification such that the user is less likely to decide to perform the startup of the engine based on the startup request or decide to continue an idling state after the startup in a case in which the time information indicates nighttime, as compared with a case in which the time information indicates daytime.

7. The remote startup system according to claim 5, wherein the notification unit is configured to change content of the notification such that the user is less likely to decide to perform the startup of the engine based on the startup request or decide to continue an idling state after the startup in a case in which the position information indicates a residential area or an indoor area, as compared with a case in which the position information indicates neither the residential area nor the indoor area.

8. The remote startup system according to claim 5, wherein:

a plurality of vehicles is provided; and the notification unit is configured to change content of the notification such that the user easily decides to perform the startup of the engine based on the startup request of one of the vehicles or decide to continue an idling state after the startup as achievement of the startup of the engine based on a startup request of the vehicles in a region corresponding to the position information is higher.

9. A center server connected to a terminal of a user and a vehicle and configured to communicate with the terminal and the vehicle, the center server being configured to receive a startup request of an engine of the vehicle that is transmitted from the terminal and transmit the startup request to the vehicle to start up the engine, the center server comprising:

a position information acquisition unit configured to acquire position information of the vehicle;

a time information acquisition unit configured to acquire time information;

a controller configured to change a performance manner of the startup of the engine based on the startup request including whether the startup of the engine is permitted according to the position information of the vehicle and the time information when the startup request is received from the terminal; and a degree-of-permission determination unit configured to determine a degree of permission of idling of the engine at a time when a position of the vehicle and the startup request are transmitted, according to the position information and the time information, wherein the controller is configured to change the performance manner such that the startup of the engine based on the startup request is less likely to be performed as the degree of permission is lower, and wherein the controller is configured to perform re-confirmation as to whether or not there is an intention to start up the engine of the vehicle from the user when the degree of permission is higher than a predetermined level.

10. A center server connected to a terminal of a user and a vehicle and configured to communicate with the terminal and the vehicle, the center server being configured to receive a startup request of an engine of the vehicle that is transmitted from the terminal and transmit the startup request to the vehicle to start up the engine, the center server comprising:

a position information acquisition unit configured to acquire position information of the vehicle;

a time information acquisition unit configured to acquire time information;

an information generation unit configured to generate information for determining content of a notification regarding performance of the startup of the engine based on the startup request performed by the terminal when the startup request is received from the terminal; and a degree-of-permission determination unit configured to determine a degree of permission of idling of the engine at a time when a position of the vehicle and the startup request are transmitted, according to the position information and the time information, and wherein the information generation unit is configured to generate the information such that the content of the notification is changed according to the position information of the vehicle and the time information, and wherein the information generation unit is configured to perform re-confirmation as to whether or not there is an intention to start up the engine of the vehicle from the user when the degree of permission is higher than a predetermined level.

* * * * *